US008784187B2

(12) United States Patent
Munakata et al.

(10) Patent No.: US 8,784,187 B2
(45) Date of Patent: Jul. 22, 2014

(54) GAMING MACHINE AND CONTROL METHOD THEREOF

(75) Inventors: Hiroki Munakata, Tokyo (JP); Kenichi Fujimori, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 477 days.

(21) Appl. No.: 13/124,769

(22) PCT Filed: Oct. 19, 2009

(86) PCT No.: PCT/JP2009/068004
§ 371 (c)(1),
(2), (4) Date: Apr. 18, 2011

(87) PCT Pub. No.: WO2010/055748
PCT Pub. Date: May 20, 2010

(65) Prior Publication Data

US 2011/0201407 A1 Aug. 18, 2011

Related U.S. Application Data

(60) Provisional application No. 61/114,825, filed on Nov. 14, 2008.

(51) Int. Cl.
*A63F 9/24* (2006.01)

(52) U.S. Cl.
USPC ..... 463/22; 463/1; 463/11; 463/12; 463/13; 273/292; 273/149 R

(58) Field of Classification Search
USPC ..... 463/1, 11, 12, 22; 273/149 R, 149 P, 292
See application file for complete search history.

(56) References Cited

U.S. PATENT DOCUMENTS 5,221,083 A 6/1993 Dote
2002/0155872 A1* 10/2002 Odom et al. ..... 463/13

(Continued)

FOREIGN PATENT DOCUMENTS

JP 03-131288 A 6/1991
JP 2005-279258 A 10/2005

(Continued)

OTHER PUBLICATIONS

"About Deck Shuffling.", closet belief 2, Dec. 6, 2006; Randomized deck for essential work, it is shuffled. Shuffle a bit about that today.
International Seach Report (PCT Forms of PCT/ISA/210 issued on Dec. 22 2009 in the corresponding International Patent Application No. PCT/JP2009/068004.

*Primary Examiner* — David L Lewis
*Assistant Examiner* — Chase Leichliter
(74) *Attorney, Agent, or Firm* — KMF Patent Services, PLLC; Kenneth M. Fagin, Esq.; S. Peter Konzel, Esq.

(57) ABSTRACT

A gaming machine of the present invention has a memory for, after a predetermined number of cards have been extracted from among a plurality of cards, storing a plurality of predetermined values which serve as a condition for shuffling the plurality of cards. Then, a specific predetermined value is determined as a condition for shuffling a plurality of cards from among the plurality of predetermined values that are stored in the memory. In addition, a game is performed in such a manner that dealer cards and player cards which are used in a game are determined from among the plurality of cards and then the determined cards are compared with each other. Further, the number of cards that is used in the game is cumulatively counted and then the respective used cards are cumulatively stored as used cards in the memory. Furthermore, as a result of repeating the game, in a case where the counted number of cards has reached a specific set predetermined value, the plurality of cards are shuffled at the time of starting a next game.

14 Claims, 16 Drawing Sheets

(56) References Cited

U.S. PATENT DOCUMENTS

| | | | | |
|---|---|---|---|---|
| 2005/0233803 | A1 | 10/2005 | Yang | |
| 2006/0128453 | A1 | 6/2006 | Hoffman | |
| 2008/0081682 | A1 | 4/2008 | Yoshizawa | |
| 2008/0182644 | A1* | 7/2008 | Lutnick et al. | 463/20 |
| 2008/0224401 | A1 | 9/2008 | Okada | |
| 2008/0227511 | A1 | 9/2008 | Sato | |
| 2009/0179378 | A1* | 7/2009 | Amaitis et al. | 273/292 |

FOREIGN PATENT DOCUMENTS

| | | | |
|---|---|---|---|
| JP | 2008-86587 | A | 4/2008 |
| JP | 2008-522715 | A | 7/2008 |
| JP | 2008-220785 | A | 9/2008 |
| JP | 2008-229323 | A | 10/2008 |

* cited by examiner

GAMING MACHINE AND CONTROL METHOD THEREOF

TECHNICAL FIELD

The present invention relates a gaming machine and a control method of the gaming machine that enables a store side to selectively set a timing of shuffling cards.

BACKGROUND ART

Conventionally, there are known different kinds of card games, such as poker, blackjack, and baccarat, which are played by a plurality of players in a gaming facility such as casino. In these card games, it is general to play games between players and a dealer by actually using betting chips.

In addition, such card games include: live-type card games in which players match up with a real dealer; and video-type, table-type card games in which players match up with a virtual dealer displayed on a video display. In the video-type card game, an image of the virtual dealer who takes action of delivering cars and then exchanging chips is displayed on a video display and then the players play card games to compete with a real dealer.

For example, a table game machine disclosed in Patent Document 1 is provided with: a display for displaying a virtual dealer and cards; and a plurality of player terminals which are integrally provided so as to surround the periphery of a dealer table. In this document, there are disclosed gaming machines at which shuffled cards are displayed while a virtual dealer is displayed as an image on a display and then card games are played for a plurality of players at a plurality of player stations.

Patent Document 1: United State Patent Application Publication No. 2005/0035548

SUMMARY OF THE INVENTION

Problems to be Solved by the Invention

In such conventional gaming machine, in a case where a card game such as blackjack is played, since a timing of shuffling cards is programmed to be fixed in advance, an expectation value relevant to a player acquisition of payment does not vary. Therefore, there is a desire for advent of a gaming machine having its new entertainment property.

Accordingly, the present invention has been made in view of the above-described circumstance, and it is an object of the present invention to provide a gaining machine which enables a store side to selectively set a timing of shuffling cards and a control method of the gaming machine.

Means for Solving the Problem

A gaming machine of the claim 1, comprising:

(i) a memory for storing a plurality of cards which are used in a game and a plurality of predetermined values which serve as a condition for, after a predetermined number of cards have been extracted from among the plurality of cards, shuffling the plurality of cards; and (ii) a processor, the processor being configured to execute processing operations including:

(a) determining a specific predetermined value which is set as a condition for shuffling the plurality of cards, from among the plurality of predetermined values that are stored in the memory, based on a input signal which inputted from a store side;

(b) determining dealer cards and player cards which are used in a game from among the plurality of cards and then executing a game for comparing the determined cards with each other;

(c) cumulatively counting the number of cards that is used in the processing (b);

(d) cumulatively storing the cards that are used in the processing (b) as used cards;

(e) determining whether or not the number of cards that is counted in the processing (c) has reached the specific predetermined value that is determined in the processing (a) as a result of repeating the processing operations (b) to (d); and (f) shuffling the plurality of cards at a time of starting a next game in a case where it is determined in the processing (e) that the counted number of cards has reached the specific predetermined value that is determined in the processing (a).

According to the present invention, in a case where the number of cards that is used in a game has reached the number of cards that is determined at the shop side, a plurality of cards are shuffled. Namely, a plurality of cards can be shuffled according to a preset timing on the store side. In this manner, a timing of shuffling cards can be arbitrarily set on the store side, thus enabling the store side to control an expectation value relevant to a player acquisition of payment on a game-by-game basis. Therefore, the expectation value relevant to the player acquisition of payment can be varied on a game-by-game basis under the control of the store side, and hence, a game having its high entertainment property can be provided.

The gaming machine of the claim 2 according to claim 1, further comprising:

a player terminal for a player to play a game; and a common display to which the player terminal is connected, wherein the processor executes processing of displaying an image of shuffling the plurality of cards on the common display according to a predetermined condition in the processing (f).

According to the present invention, it is possible to determine whether to display an image of shuffling a plurality of cards according to a predetermined condition (for example, settings at the store side) on a common display. In this way, the store side can arbitrarily set whether to display an effect image as to a timing of shuffling cards, thus enabling players to keep track of whether cards are shuffled according to a situation. Therefore, in a case where an effect image is displayed as to shuffling cards, players can keep track of with which timing in a game, cards have been shuffled, and can have a sense of expectation for the remaining cards which are not used in the game.

The gaming machine of the claim 3 according to claim 1, wherein the processor is configured to execute processing operations including:

in the processing (d), cumulatively storing the dealer cards and the player cards that are used in the processing (b) in a first sequential order, in a region for storing the used cards of the memory; and in the processing (f), (f1) in a case where it is determined in the processing (e) that the counted number of cards has reached the specific predetermined value that is determined in the processing (a), storing in the memory in a second sequential order the used cards that are cumulatively stored in the memory in the processing (d) and the unused cards that have not been used in the game;

(f2) dividing the plurality of cards that are stored in the memory in the second sequential order in the processing (f1), into a first card group and a second card group;

(f3) extracting cards from the first card group and the second card group according to a number of cards that is randomly determined; and alternately storing the extracted cards in a memory so as to shuffle the first card group and the second card group.

According to the present invention, used cards which have been used in a game and unused cards which have not been used in the game are divided into two card groups and then cards extracted from the groups of unused cards and used cards are shuffled according to a number of cards that is randomly determined. Thus, the unused cars and the used cards are alternately shuffled according to the number of cards that is randomly determined, and therefore, a plurality of the used cards may be shuffled in a game in a state in which they are superimposed on each other. Hence, players can have a sense of expectation that cards used in a game once are collectively arranged, and can maintain a willingness to continue a game by causing the players to predict kinds of cards to be delivered in a next game.

The gaming machine of the claim 4 according to claim 1, wherein the processor is configured to execute processing operations including:

in the processing (d), cumulatively storing the dealer cards and the player cards that are used in the processing (b) in the first sequential order, in the region for storing the used cards of the memory;

in the processing (f) of shuffling cards, (f1) in a case where it is determined in the processing (e) that the counted number of cards has reached the specific predetermined value that is determined in the processing (a), storing in the memory in the second sequential order the used cards that are cumulatively stored in the memory in the processing (d) and the unused cards that have not been used in the game;

(f2) dividing the plurality of cards that are stored in the memory in the second sequential order in the processing (f1), into a first card group and a second card group;

(f3) extracting cards from the first card group and the second card group according to the number of cards that are randomly determined;

alternately storing the extracted cards in the memory so as to shuffle the first card group and the second card group;

(f4) dividing into a plurality of groups the plurality of cards that are alternately stored in the memory in the processing (f3) by the randomly determined number of cards; and (f5) storing the cards of the plurality of groups in the memory so that the plurality of groups are in a third sequential order.

According to the present invention, used cards which have been used in a game and unused cards which have not been used in the game are divided into two card groups, and then, cards extracted from the groups of unused cards and used cards are shuffled according to the number of cards that is randomly determined. Further, after the shuffled card groups have been divided into a plurality of groups, cards are shuffled again. In this manner, the unused cards and the used cards are alternately shuffled according to the number of cards that is randomly determined and then are shuffled again after being grouped. Therefore, the used cards may be shuffled in a game in a state in which they are superimposed on each other. Hence, players can have a sense of expectation that cards used in a game once are collectively arranged, and can maintain a willingness to continue a game by causing the players to predict kinds of cards to be delivered in a next game.

A gaming machine of the claim 5, comprising:

(i) a memory for storing a plurality of cards which are used in a game and a plurality of predetermined values which serve as a condition for, after a predetermined number of cards have been extracted from among the plurality of cards, shuffling the plurality of cards; and (ii) a processor, the processor being configured to execute processing operations including:

(a) determining a specific predetermined value which is set as a condition for shuffling the plurality of cards, from among a plurality of predetermined values which are stored in the memory, based on an input signal which is inputted from a store side;

(b) determining dealer cards and player cards which are used in a game, from among the plurality of cards and then executing a game for comparing the determined cards with each other;

(c) cumulatively counting the number of cards that is used in the processing (b);

(d) cumulatively storing the dealer cards and the player cards that are used in the processing (b) in a first sequential order, in a region for storing the used cards of the memory;

(e) as a result of repeating the processing operations (b) to (d), determining whether or not the number of cards that is counted in the processing (c) has reached the specific predetermined value that is determined in the processing (a);

(f) in a case where it is determined in the processing (e) that the counted number of cards has reached the specific predetermined value that are determined in the processing (a), storing in the memory in a second sequential order the used cards that are cumulatively stored in the memory in the processing (d) and the unused card that have not been used in the game;

(g) dividing the plurality of cards that are stored in the memory in the second sequential order in the processing (f), into a first card group and a second card group;

(h) extracting cards from the first card group and the second card group according to the number of cards that is randomly determined; and alternately storing the extracted cards in the memory so as to shuffle the cards in the first card group and the second card group.

According to the present invention, a plurality of cards can be shuffled according to a preset timing on the store side. In this way, the store side can arbitrarily set a timing of shuffling cards, thus enabling the store side to control an expectation value relevant to a player acquisition of payment on a game-by-game basis. In this manner, the expectation value relevant to the player acquisition of payment can be varied on the game-by-game basis under the control of the store side; and therefore, a game having its high entertainment property can be provided. In addition, unused cards and used cards are alternately shuffled according to the number of cards that is randomly determined, and therefore, the used cards may be shuffled in a game in a state in which they are superimposed on each other. Hence, players can have a sense of expectation that cards used in a game once are collectively arranged, and can maintain a willingness to continue a game by causing the players to predict kinds of cards to be delivered in a next game.

The gaming machine of the claim 6 according to claim 5, further comprising:

a player terminal for a player to play a game; and a common display to which the player terminal is connected, wherein the processor executes processing of displaying an image of shuffling the plurality of cards on the common display according to a predetermined condition in the processing operations (f) to (h).

According to the present invention, it is possible to determine whether to display an image of shuffling a plurality of cards according to a predetermined condition (for example, settings on the store side) on a common display. In this manner, the store side can arbitrarily set whether to display an effect image as to a timing of shuffling cards, thus enabling players to keep track of whether cards are shuffled according to a situation. Therefore, in a case where an effect image is displayed as to shuffling cards, players can keep track of with which timing in a game, cards have been shuffled, and can have a sense of expectation for the remaining cards which are not used in the game.

The gaming machine of the claim 7 according to claim 5, wherein the processor is configured to execute processing operations including:

(j) dividing the plurality of cards that are alternately stored in the memory in the processing (h), into a plurality of groups by the number of cards that is randomly determined; and (k) storing the cards of the plurality of groups in the memory so that the plurality of groups are in a third sequential order.

According to the present invention, used cards which have been used in a game and unused cards which have not been used in the game are divided into two card groups and then cards extracted from the groups of unused cards and used cards are shuffled according to the number of cards that is randomly determined. Further, after the shuffled card groups have been divided into a plurality of groups, cards are shuffled again. In this manner, the unused cards and the used cards are alternately shuffled according to the number of cards that is randomly determined and then are shuffled again after being grouped. Therefore, the used cards may be shuffled in a game in a state in which they are superimposed on each other. Hence, players can have a sense of expectation that cards used in a game once are collectively arranged, and can maintain a willingness to continue the game by causing the players to predict kinds of cards to be delivered in a next game.

A gaming machine control method of the claim 8, comprising the steps of:

(a) from a memory for, after a predetermined number of cards have been extracted from among a plurality of cards, storing a plurality of predetermined values which serve as a condition for shuffling the plurality of cards, determining a specific predetermined value which is set as the condition for shuffling the plurality of cards, based on an input signal which is inputted from a store side;

(b) determining dealer cards and player cards which are used in a game from among the plurality of cards and then executing a game for comparing the determined cards with each other;

(c) cumulatively counting the number of cards that is used in the step (b);

(d) cumulatively storing in the memory the cards that are used in the step (b) as used cards;

(e) as a result of repeating the steps (b) to (d), determining whether or not the number of cards that is counted in the step (c) has reached the specific predetermined value that is determined in the step (a); and (f) in a case where it is determined in the step (e) that the counted number of cards has reached the specific predetermined value determined in the step (a), shuffling the plurality of cards at a time of starting a next game.

According to the present invention, a plurality of cards can be shuffled according to a preset timing on the store side. In this manner, the store side can arbitrarily set a timing of shuffling cards, thus enabling the store side to control an expectation value relevant to the player acquisition of payment on a game-by-game basis. Accordingly, the expectation value relevant to the player acquisition of payment can be varied on the game-by-game basis, so that a game having its high entertainment property can be provided. In addition, unused cards and used cards are alternatively shuffled according to the number of cards that is randomly determined. Therefore, the used cards may be shuffled in a game in a state in which they are superimposed on each other. Hence, players can have a sense of expectation that cards used in a game once are collectively arranged, and can maintain a willingness to continue a game by causing the players to predict kinds of cards to be delivered in a next game.

The gaming machine control method of the claim 9 according to claim 8, wherein the step (f) includes the step of displaying an image of shuffling the plurality of cards in a common display according to a predetermined condition.

According to the present invention, it is possible to determine whether to display an image of shuffling a plurality of cards according to a predetermined condition (for example, settings on the store side) on a common display. In this manner, the store side can arbitrarily set whether to display an effect image as to a timing of shuffling cards, thus enabling players to keep track of whether cards are shuffled according to a situation. Therefore, in a case where an effect image is displayed with respect to shuffling cards, players can keep track of with which timing in a game, cards have been shuffled, and can have a sense of expectation for the remaining cards that have not been used in the game.

The gaming machine control method of the claim 10 according to claim 8, wherein:

the step (d) includes the step of cumulatively storing the dealer cards and the player cards that are used in the step (b) in a first sequential order in a region for storing the used cards of the memory;

the step (f) of shuffling cards includes the steps of:

(f1) in a case where it is determined in the step (e) that the counted number of cards has reached the specific predetermined value that is determined in the step (a), storing in the memory in a second sequential order the used cards that are cumulatively stored in the step (d) and unused cards which have not been used in the game;

(f2) dividing the plurality of cards that are stored in the memory in the second sequential order in the step (f1), into a first card group and a second card group; and (f3) extracting cards from the first card group and the second card group according to the number of cards that is randomly determined and then alternately storing the extracted cards in the memory so as to shuffle the first card group and the second card group.

According to the present invention, used cards which have been used in a game and unused cards which have not been used in the game are divided into two card groups and then cards extracted from the groups of unused cards and used cards are shuffled according to the number of cards that is randomly determined. In this manner, the unused cars and the used cards are alternately shuffled according to the number of cards that is randomly determined; and therefore, a plurality of the used cards may be shuffled in a game in a state in which they are superimposed on each other. Hence, players can have a sense of expectation that cards having been used in a game once are collectively arranged, and can maintain a willingness to continue a game by causing the players to predict kinds of cards to be delivered in a next game.

The gaming machine control method of the claim 11 according to claim 8, wherein:

the step (d) includes the step of cumulatively storing the dealer cards and the player cards that are used in the step (b) in the first sequential order in the region for storing the used cards of the memory; and the step (f) of shuffling the cards includes the steps of:

(f1) in a case where it is determined in the step (e) that the counted number of cards has reached the specific predetermined value that is determined in the step (a), storing in the memory in a second sequential order the used cards that are cumulatively stored in the step (d) and unused cards which have not been used in the game;

(f2) dividing the plurality of cards that are stored in the memory in the second sequential order in the step (f1), into a first card group and a second card group;

(f3) extracting cards from the first card group and the second card group according to the number of cards that is randomly determined and then alternately storing the extracted cards in the memory so as to shuffle the first card group and the second card group;

(f4) dividing the plurality of cards that are alternately stored in the memory in the step (f3), into a plurality of groups by the number of cards that is randomly determined; and (f5) storing the cards of the plurality of groups in the memory so that the plurality of groups is in a third sequential order.

According to the present invention, used cards which have been used in a game and unused cards which have not been used in the game are divided into two card groups, and then, cards extracted from the groups of unused cards and used cards are shuffled according to the number of cards that is randomly determined. Further, after the shuffled card groups have been divided into a plurality of groups, cards are shuffled again. In this manner, the unused cards and the used cards are alternately shuffled according to the number of cards that is randomly determined and then are shuffled again after being grouped. Therefore, the used cards may be shuffled in a game in a state in which they are superimposed on each other. Hence, players can have a sense of expectation that cards having been used in a game once are collectively arranged, and can maintain a willingness to continue a game by causing the players to predict kinds of cards to be delivered in a next game.

Effect of the Invention

According to the present invention, there can be provided a gaming machine and a control method of the gaming machine enabling a store side to selectively set a timing of shuffling cards.

BEST MODES FOR CARRYING OUT THE INVENTION

Figure 1:
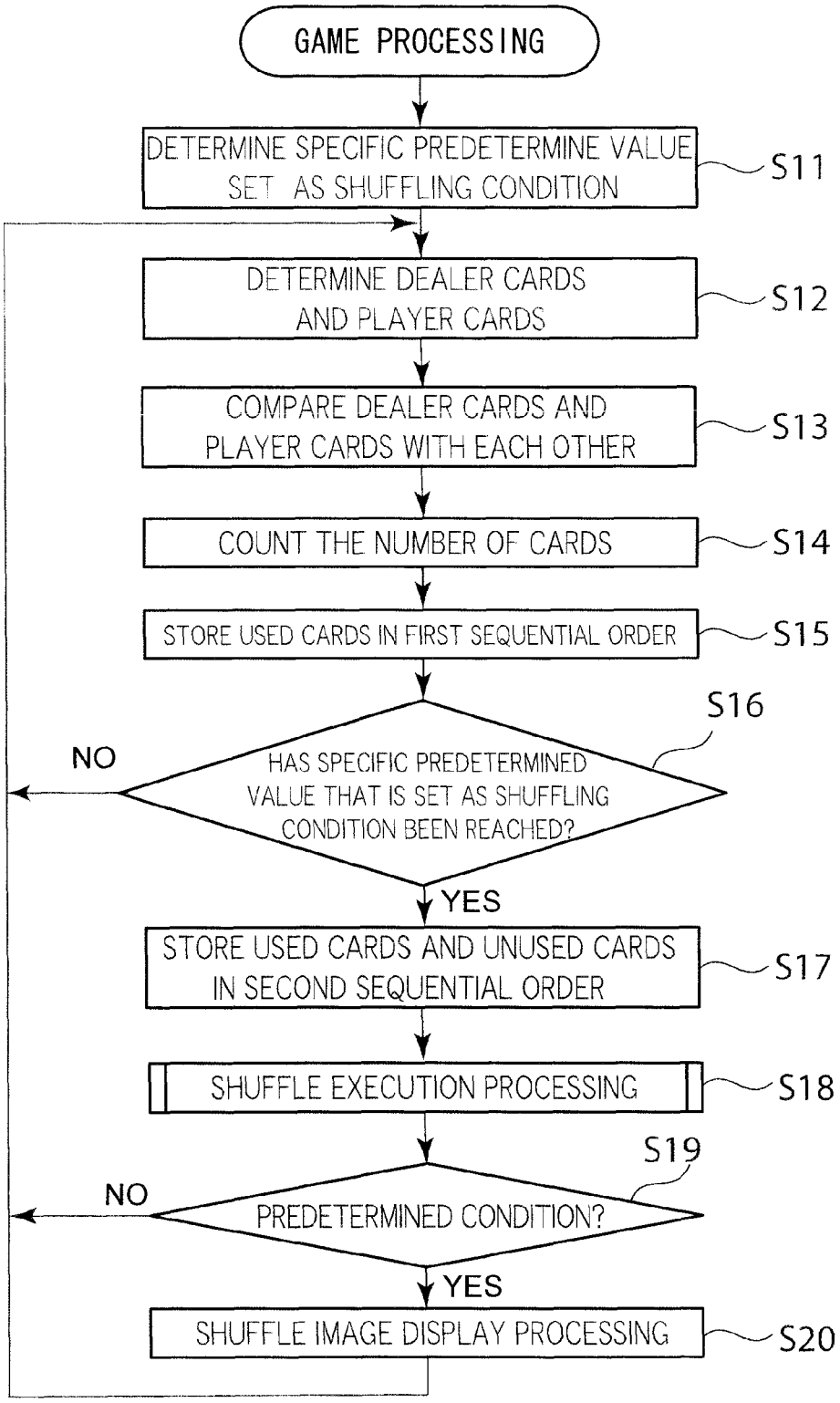
FIG. 1 It is a schematic diagram illustrating a flowchart which illustrates a subroutine of game processing at a gaming machine according to an embodiment of the present invention.

Hereinafter, a gaming machine according to an embodiment of the present invention will be described with reference to the drawings. First, characteristics of game processing at the gaming machine that is designated by reference numeral 1 will be described with reference to FIG. 1. FIG. 1 is a flowchart illustrating a subroutine of game processing.

Figure 2:
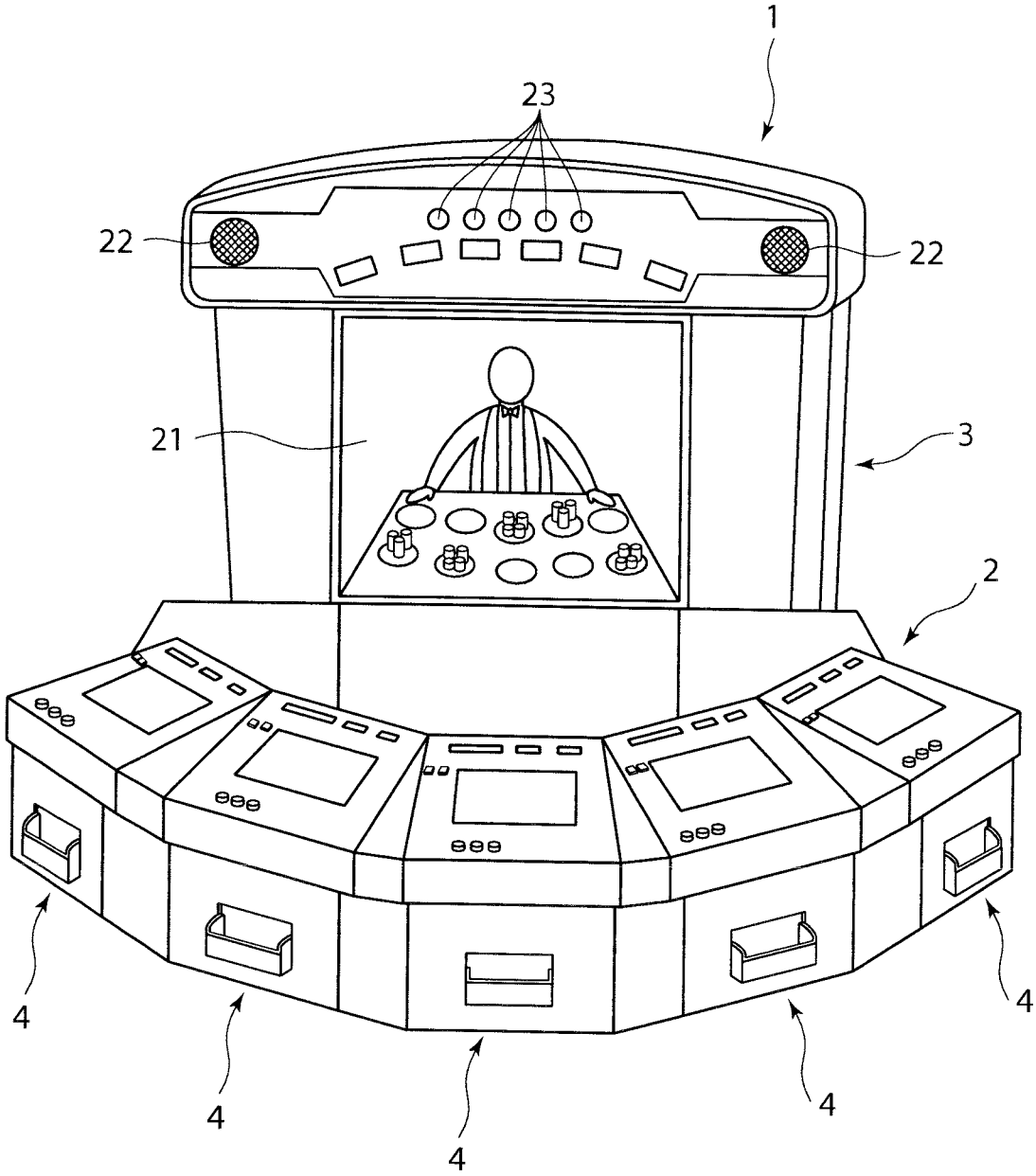
FIG. 2 It is a view showing an appearance of the gaming machine.

The gaming machine 1 is a card game machine at which a blackjack game using trump cards is played, for example. This gaming machine, as shown in FIG. 2, is provided with: a plurality of player terminals 4 for a plurality of players to play a game; a common display 21 for displaying a dealer having a way in the game; a RAM 42 having game programs stored therein; and a CPU 41 for controlling the game programs.

In addition, the RAM 42 stores: 208 cards made of four groups with 52 cards being contained in one group; and the number of cards that is set as a condition for shuffling the 208 cards (for example, 52, 80, or 104 cards).

As shown in FIG. 1, in step S11, the CPU 41 determines a specific number of cards (for example, 80 cards) set as a condition for shuffling a plurality of cards, from among the number of cards (for example, 52, 80, or 104 cards) stored in the RAM 42 on the basis of an input signal inputted from a casino store side.

Then, in step S12 and step S13, the CPU 41 determines dealer cards and player cards used in a game from among the plurality of cards and then perform game by comparing these cards with each other. Subsequently, in step S14, the CPU 41 cumulatively counts in the RAM 42 the number of cards used in a game from among the plurality of cards.

Further, in step S15, the CPU 41 cumulatively stores the dealer cards and the player cards that are used in step S12 and step S13 in a first sequential order, in a region for storing used cards in the RAM 42. The first sequential order used here denotes arranging the player cards under the dealer cards and then cumulatively storing the thus arranged cards on a game-by-game basis.

Furthermore, in step S16, the CPU 41 determines whether or not the number of cards that is counted in step S14 has reached the specific number of cards that is determined in step S11 (for example, 80 cards). Still furthermore, in step S17, in a case where the CPU 41 determines that the number of cards that is used in a game has reached the specific number of cards (for example, 80 cards), on the basis of the determination result in step S16, the RAM 42 stores in a second sequential order, unused cards which have not been used in the game, together with the used cards that are stored in the RAM 42 in step S15. The second sequential order used here denotes arranging used cards under unused cards.

Yet furthermore, in step S18, in a case where the CPU 41 determines that the number of cards that is used in a game has reached the specific number of cards (for example, 80 cards), the CPU 41 executes processing of shuffling the cards that are stored in the RAM 42 in step S17, at the time of starting a next game. In this step, the CPU 41 first divides the cards stored in the RAM 42 in step S17, into a first card group and a second card group. Afterwards, the CPU 41 randomly determines a number of cards; extracts cards from among the cards of the first and second card groups according to the predetermined number of cards; and then, alternately stores in the RAM 42 the extracted cards so as to shuffle the first card group and the second card group.

Moreover in step S19 and step S20, the CPU 41 displays on a common display 21 an effect image of shuffling a plurality of cards according to a predetermined condition in order to indicate that a dealer has shuffled cards for the players with this timing. The predetermined condition used here denotes the settings at the casino store side.

As described above, the gaming machine 1 shuffles a plurality of cards in a case where the number of cards that is used in a game has reached the number of cards that is determined on the store side in a blackjack game using 208 cards. Namely, a plurality of cards can be shuffled according to a preset timing on the store side. In this way, the casino store side can set a timing of shuffling cards, thus enabling the casino store side to arbitrarily control an expectation value relevant to the player acquisition of payment. In addition, the gaming machine 1 determines whether to display an effect image of the dealer shuffling cards according to a preset state on the store side. Therefore, it is possible to control a state of keeping track of unused cards which are strategically counted in a player's head in a game. Hence, a balance between a profit at the casino store side and a player willingness to continue a game can be adjusted.

Next, a configuration of the gaming machine 1 will be described with reference to FIG. 2 and FIG. 3. FIG. 2 is a view showing an appearance of the gaming machine 1 and FIG. 3 is a view showing an appearance of a player terminal 4.

The gaming machine 1, as shown in FIG. 2, is basically comprised of: a table portion 2 at which a player takes a seat and plays a game; and a panel portion 3 which is installed in front of the table portion 2 and displays a dealer animation image or the like.

At the table portion 2, a plurality of player terminals 4 called satellites (five player terminals in FIG. 2) are disposed in a substantially fan-like shape. While the embodiment describes in detail a case in which the gaming machine 1 is provided with five player terminals 4, the game machine 1 may be provided with five or more player terminals 4 in the present invention.

Figure 3:
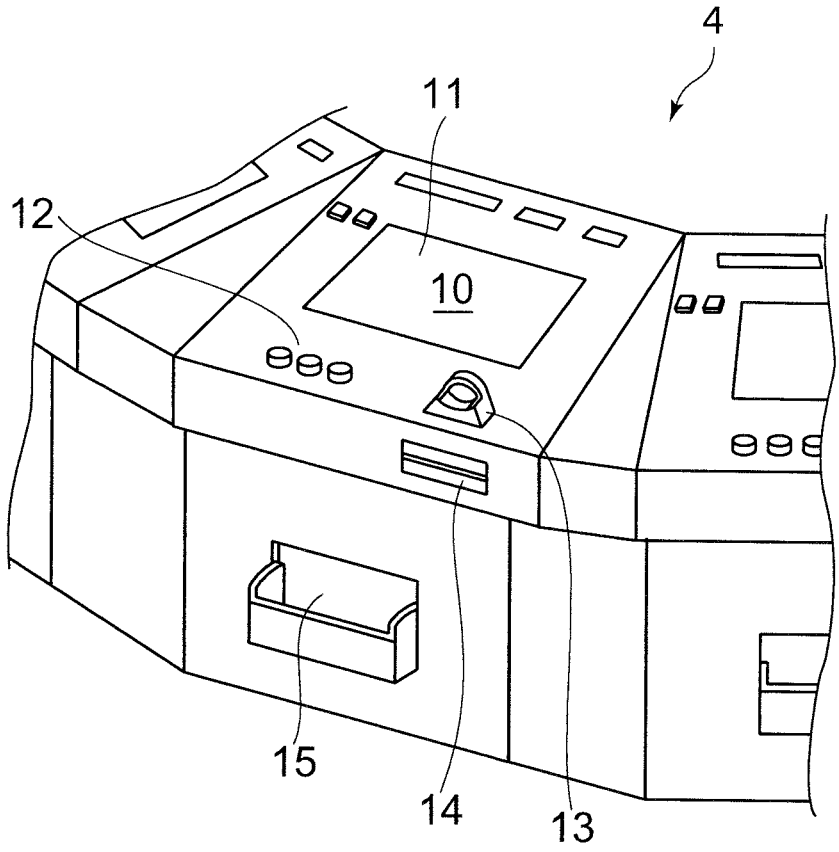
FIG. 3 It is a view showing a player terminal.

At a top face center of the player terminal 4, as shown in FIG. 3, a liquid crystal display 10 is provided for displaying a betting screen or a game result or the like (see FIG. 7) to be described later. In addition, on a top face of the liquid crystal display 10, a touch panel 11 is provided for inputting an operation such as betting.

At the player side of the player terminal 4, an operating button 12 is provided for making a payout operation or the like, and a coin insertion slot 13 is provided for inserting coins or medals. In addition, a bill insertion slot 14 is provided for inserting bills. Further, at the lower side of the bill insertion slot 14, a coin payout exit 15 is provided for paying out to a player the coins or medals corresponding to the credits that are cumulatively stored when a payout operation has been made.

The panel portion 3, as shown in FIG. 2, is connected to the plurality of player terminals 4. Further, a common display 21 is provided at the panel portion 3.

The common display 21 is adapted to display an image of a dealer who delivers cards relating to game or exchanging chips or the contents of delivered cards. In addition, on the common display 21, an image of shuffling a plurality of cards is displayed in a case where the store side sets the contents of displaying the image of shuffling cards.

Further, a speaker 22 for outputting music or an effect sound in accordance with the progress of a game is provided at the panel portion 3, and an LED 23 to be lit at the time of providing a variety of effects is provided at an upper part of the common display 21.

At the gaming machine 1 configured as described above, a blackjack game is played. First, each player who plays a game takes a seat in front of the player terminal 4 and then bets his or her desired bet amount by using a betting screen which is displayed on the liquid crystal display 10. Afterwards, on the common display 21 and each of the liquid crystal displays 10, an image of cards which are delivered to players and a dealer, respectively, is displayed. Any of the players or the dealer whose total of numbers of the delivered cards is 21 or less and is close to 21 is determined to a winner and then the relevant image is displayed on the common display 21.

The cards that are used at the abovementioned gaming machine 1 are the same as trump cards which are generally used. The cards used constitute 52 cards which are formed by combining 13 kinds of ranks (A, 2, 3, 4, 5, 6, 7, 8, 9, 10, J, Q, K) with each of four kinds of suits (spade, heart, diamond, club). In the embodiment, a blackjack game is played by using four groups of cards (208 cards) while a total of 52 cards excluding joker are contained in one group.

Figure 4:
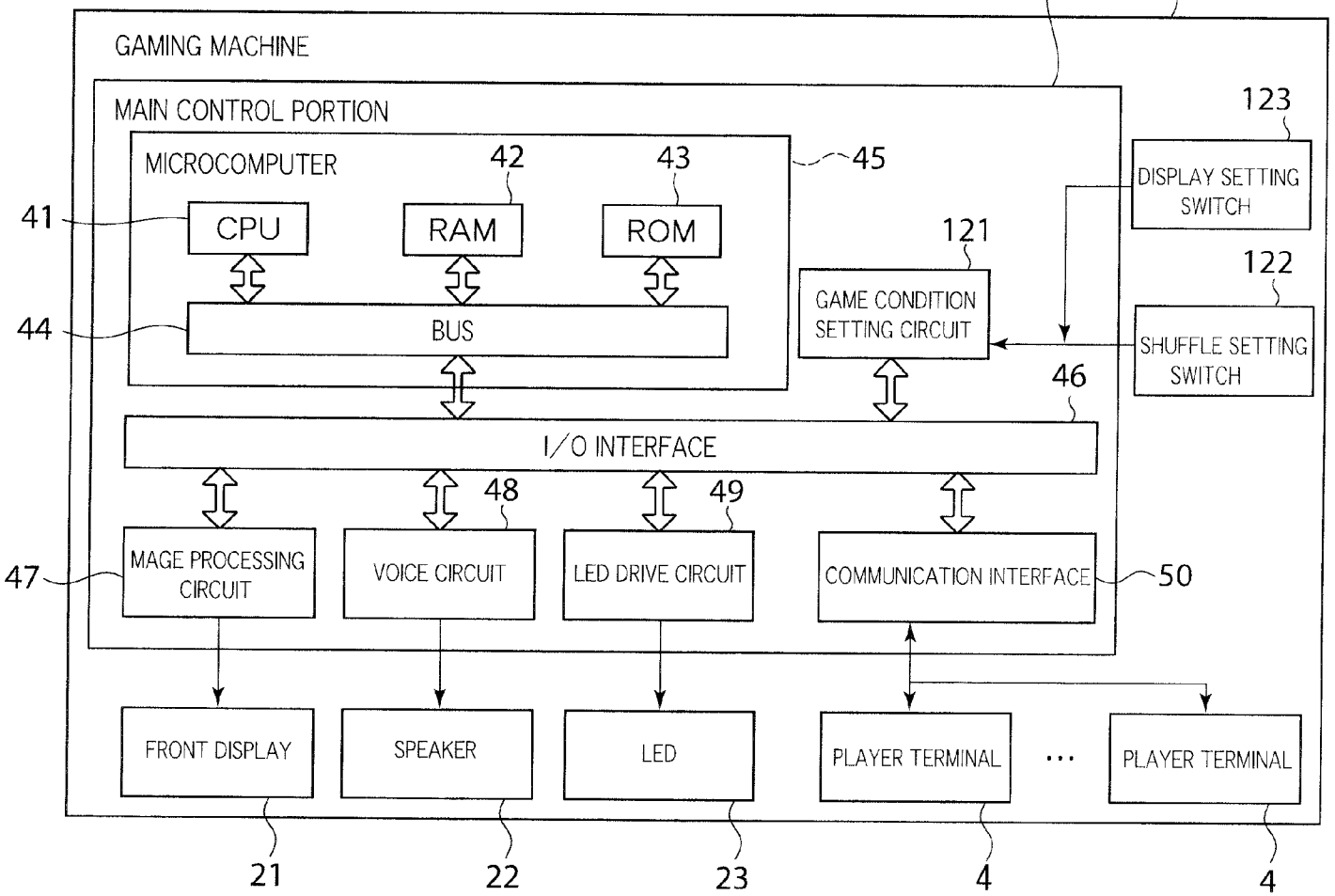
FIG. 4 It is a block diagram depicting an internal configuration of the gaming machine.
Figure 5:
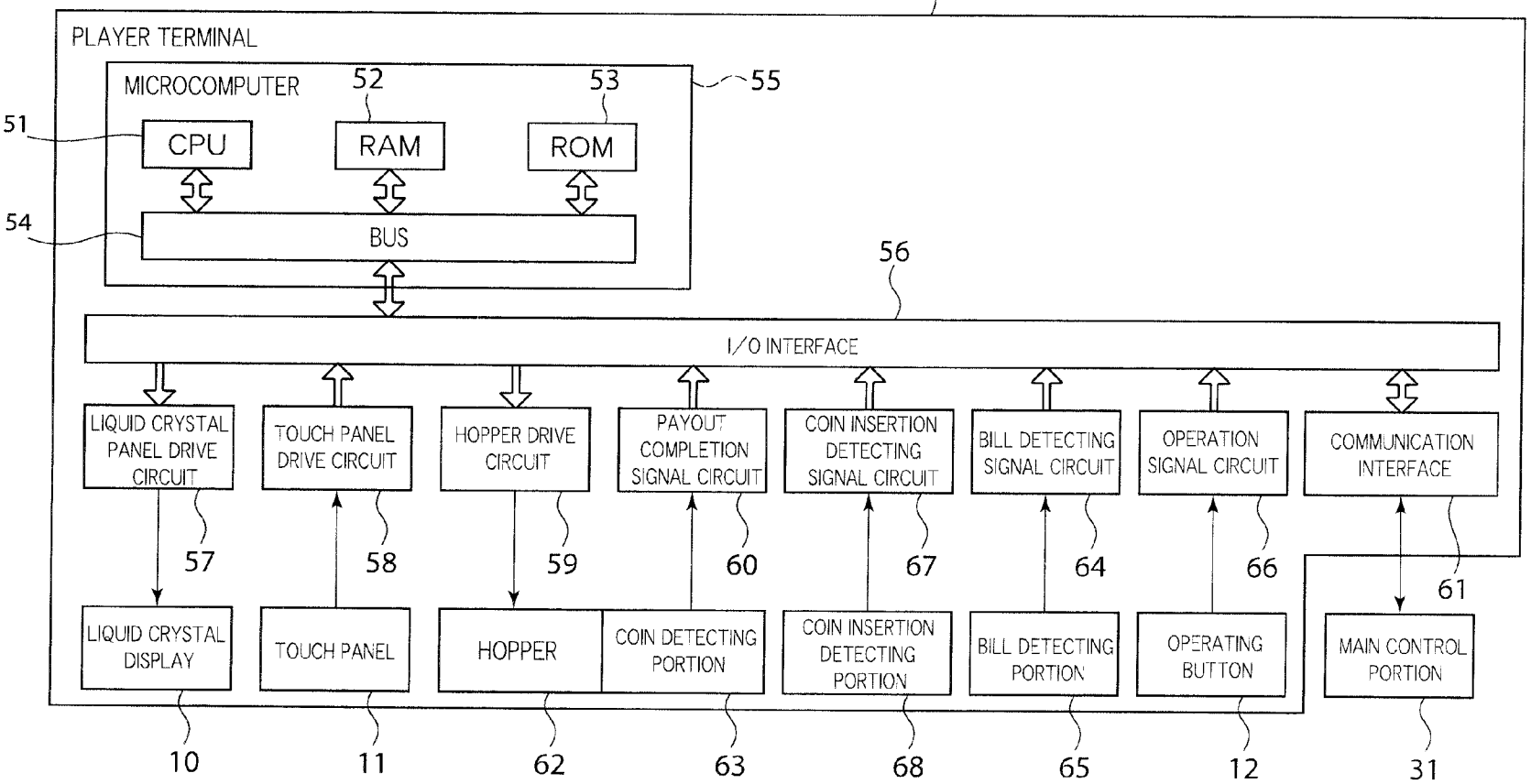
FIG. 5 It is a view showing a block diagram depicting an internal configuration of the player terminal.

Next, an internal configuration of the gaming machine 1 will be described with reference to FIG. 4 and FIG. 5. FIG. 4 is a block diagram depicting the internal configuration of the gaming machine 1; and FIG. 5 is a block diagram depicting an internal configuration of a player terminal 4.

The gaming machine 1, as shown in FIG. 4, is comprised of: a main control portion 31; a plurality of player terminals 4 which are connected to the main control portion 31; and a variety of peripheral devices.

The main control portion 31 is mainly comprised of a CPU 41, a RAM 42, and a RAM 43 while a microcomputer 45 comprised of a bus 44 for transferring data therebetween is employed as a core machine. The CPU 41 of the main control portion 31 is equivalent to a processor in the present invention.

The ROM 43 stores a variety of programs for performing processing required for controlling the gaming machine 1 and a data table or the like. A blackjack game is performed by means of the CPU 41 of the main control portion 31 on the basis of the game programs that are stored in the ROM 43 (including a blackjack game program) and a variety of signals that are received from the player terminals 4.

The RAM 42 of the main control portion 31 temporarily stores a variety of data computed by the CPU 41. In addition, in the RAM 42, a setting storage region is provided for storing a plurality of predetermined values (for example, 52, 80, 104 cards) in advance as a condition for shuffling a plurality of cards. Further, in the RAM 42, a display setting storage region is provided for storing information relating to whether or not to display an image of shuffling cards on the common display 21. The RAM 42 of the main control portion 31 is equivalent to a memory in the present invention.

In addition, the CPU 41 of the main control portion 31 is connected via an I/O interface 46 to an image processing circuit 47, a voice circuit 48, an LED drive circuit 49, a communication interface 50, and a game condition setting circuit 121.

The common display 21 is connected to the image processing circuit 47 and a speaker 22 is connected to the voice circuit 48. In addition, an LED 23 is connected to the LED drive circuit 49 and five player terminals 4 are connected to the communication interface 50.

The CPU 41 of the main control portion 31 displays an image on the common display 21 on the basis of the abovementioned game program, outputs a sound from the speaker 22 and then causes the LED 23 to light up. In addition, the CPU 41 transmits a variety of signals to each of the player terminals 4 on the basis of the abovementioned game program.

A shuffle setting switch 122 and a display setting switch 123 are connected to the game condition setting circuit 121. The shuffle setting switch 122 and the display setting switch 123 are operable on the store side, and the operations on the store side include: a manual operation performed by the staff on the store side; and an automatic operation performed by a central computer or the gaming machine 1.

The shuffle setting switch 122 is operable on the store side, and is the one that determines a specific number of cards (for example, any one of up to the 52th, 80th, 104th cards) for shuffling cards in a game according to the operation on the store side. By means of this shuffle switch 122, the specific number of cards (for example, up to the 80th cards) for shuffling the determined cards is stored in a setting storage region of the RAM 42.

The display setting switch 123 is operable on the store side, and is the one that determines whether or not to display an image of shuffling cards on the common display 21 according to the operation on the store side. By means of this display setting switch 123, the determined effect display image or the like is stored in a display setting storage region of the RAM 42.

A player terminal 4, as shown in FIG. 5, is mainly comprised of a CPU 51, a RAM 52, and a ROM 53 while a microcomputer 55 comprised of a bus 54 for transferring data therebetween is employed as a core machine.

The ROM 53 stores a variety of programs for performing processing required for controlling the player terminals 4 and a data table or the like. In addition, the RAM 52 temporarily stores the number of credits that is currently cumulatively stored in the player terminal 4, bet targets which are betted by players, a bet amount (the number of credits) which is betted for that bet target, and a variety of data which are computed by the CPU 51.

In addition, the CPU 51 of the player terminal 4 is connected via an I/O interface 56 to a liquid crystal panel drive circuit 57, a touch panel drive circuit 58, a hopper drive circuit 59, a payout completion signal circuit 60, a coin insertion detecting signal circuit 67, a bill detecting signal circuit 64, an operating signal circuit 66, and a communication interface 61.

Further, a liquid crystal display 10 is connected to the liquid crystal panel drive circuit 57; a touch panel 11 is connected to the touch panel circuit 58, and a hopper 62 is connected to the hopper drive circuit 59. A coin detecting portion 63 is connected to the payout completion signal circuit 60; a coin insertion detecting portion 68 is connected to the coin insertion detecting signal circuit 67; a bill detecting portion 65 is connected to the bill detecting signal circuit 64; and an operating button 12 is connected to the operating signal circuit 66, respectively.

The hopper 62 is provided inside of the player terminal 4 and pays out coins from a coin payout exit 15 on the basis of a control signal outputted from the CPU 51. In addition, in a case where the coin detecting portion 63 is provided inside of the coin payout exit 15. In a case of detecting that a predetermined number of coins have been paid out from the coin payout exit 15, this coin detecting portion transmits a signal indicating the fact to the CPU 51.

When the coin insertion detecting portion 68 detects that a coin has been inserted from the coin insertion slot 13, this detecting portion detects a kind of that coin and then transmits a detection signal indicating the detected kind of the coin to the CPU 51. Then, the CPU 51 stores the detected predetermined amount of coins as one credit to the RAM 52.

When the bill detecting portion 65 has accepted a bill, this detecting portion detects the amount of the bill and then transmits a detection signal indicating the detected amount of the bill to the CPU 51. Then, the CPU 51 stores the detected predetermined amount of the bill as one credit to the RAM 52. The operating button 12 is a button for accepting a player payout operation in a case where coin payout has been determined.

Figure 6:
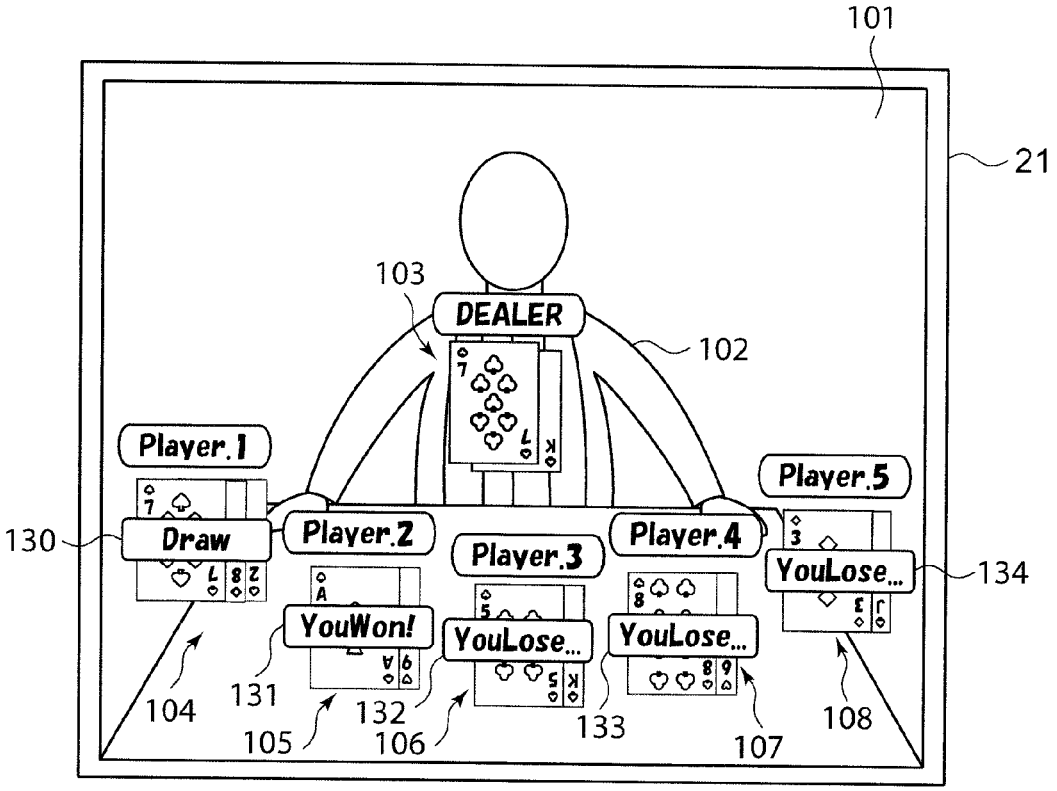
FIG. 6 It is a view showing a display example of a common display of the player terminal.
Figure 7:
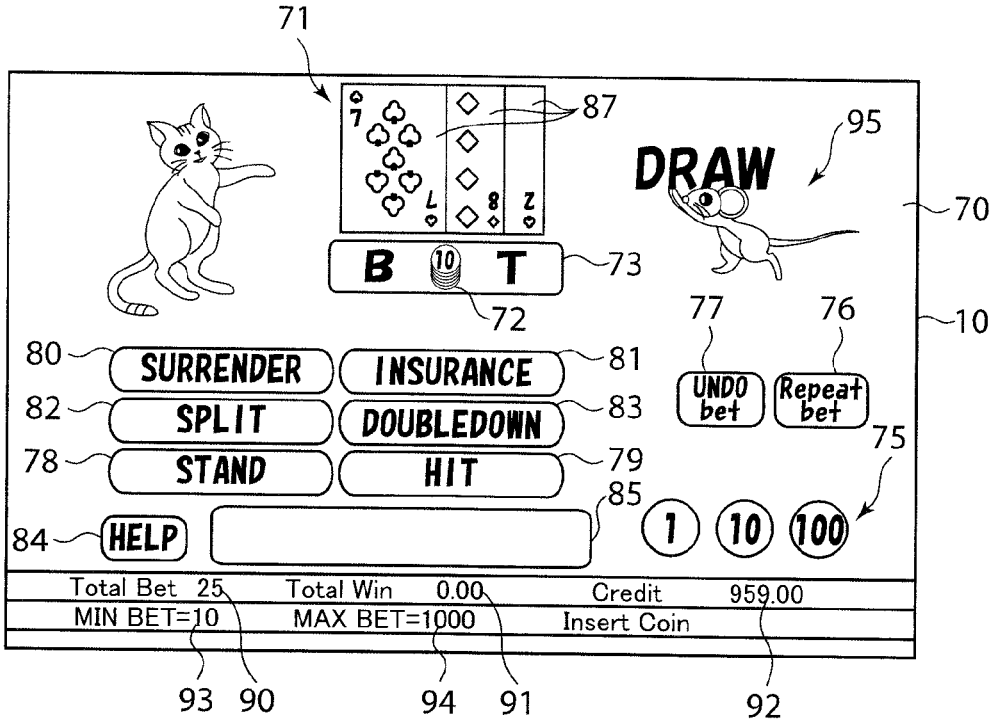
FIG. 7 It is a view showing a display example of a liquid crystal display of the player terminal.

Next, one example of an image which is displayed on the common display 21 of the player terminal 4 will be described with reference to FIG. 6 and FIG. 7. FIG. 6 and FIG. 7 are views each showing a display example of the common display of the player terminal.

As shown in FIG. 6, a main screen 101 is displayed on the common display 21 while in the play of a blackjack game. The main screen 101 displays a dealer image 102 which undergoes animation such as delivering cards along the progress of a game, in order to enhance the realistic sensation of the game.

In addition, an image 103 of the dealer cards that are delivered to the dealer is displayed at a substantial center of the main screen 101. Further, images 104 to 108 of the player cards that are delivered to the players (a maximum of five players) who play a game at the player terminals 4 are displayed at the lower side of the main screen 101.

In addition, win or loss result images 130 to 134 indicating a win or loss between each of the players and the dealer are displayed. Therefore, a player can be aware of kinds of the cards that are delivered to the dealer or kinds of the cards that are delivered to other players, by referring to the main screen 101. Further, a player can also be aware of a result of other players' win or loss, together with his or her own win or loss result.

As shown in FIG. 7, on the liquid crystal display 10 of the player terminal 4, a bet screen 70 is displayed while in the play of a blackjack game. A player bets credits for a predetermined amount by operating the touch panel 11 on the basis of the bet screen 70. Similarly, a player can operate the touch panel 11, thereby making an operation of making a request for addition of his or her owned cards or an operation of increasing a bet amount.

The bet screen 70 used here is comprised of: a player card display region 71 for displaying an image 87 of the cards that are delivered to each of the players; a chip display area 73 for displaying an image 72 of betted chips; and an information display area for displaying a variety of operating buttons and player information.

The player card display region 71 is a display area for displaying an image 87 of the player cards that are delivered to each of the players. In other words, the image 87 of the plurality of cards, which is displayed in the player card display region 71, is the one of cards which are delivered to each of the players who plays a game while taking a seat at each of the player terminals 4.

In addition, the chip display area 73 is adapted to display an image 72 of chips equivalent to a bet amount which is betted by a player (for example, betting chips for 50 credits in FIG. 7) and performs effect processing for enhancing a realistic sensation. Then, the player selects a bet button 75 to be described later and then sets a bet amount, and the CPU 51 transmits the bet amount to the main control portion 31.

Further, a plurality of bet buttons 75 (three kinds of one credit, 10 credits, and 100 credits in the embodiment) are provided at the lower right side of the chip display area 73. A player can set a bet amount to be betted in a current game, by operating any one of the bet buttons 75.

Furthermore, a Repeat button 76 and an UNDO bet button 77 are provided at an upper side of the bet buttons 75. A player can bet a bet amount which is identical to that in a previous game by operating the Repeat bet button 76. In addition, the player can cancel a bet operation that has been performed once, by operating the UNDO bet button 77.

On the other hand, operating buttons which are used for a player to compete with the dealer are displayed at the lower left side of the chip display area 73. Specifically, a STAND button 78, a HIT button 79, a SURRENDER button 80, an INSURANCE button 81, a SPLIT button 82, and a Double Down button 83 are provided.

The STAND button 78 is a button to be operated when a player competes with the dealer by using currently delivered cards. The HIT button 79 is a button to be operated when a player makes a request for a new card in addition to the currently delivered cards. The HIT button 79 can be used until a total of numbers which is displayed on the delivered cards becomes 21 or more.

The SURRENDER button 80 is a button to be operated when a player withdraws from completing in a current game. When the SURRENDER button 80 is operated, half of the bet amount at that time point is collected, and the remaining half is returned to the player.

The INSURANCE button 81 is a button for a case in which cards delivered to the dealer becomes blackjack. When the INSURANCE button 81 is operated, half of the bet amount that is betted by a player is INSURANCE-betted. Then, in the INSURANCE betted game, in a case where the cards that are delivered to the dealer has become blackjack, the bet amount and INSURANCE-betted amount are returned to the player. On the other hand, in a case where the cards that are delivered to the dealer are not blackjack, only the INSURANCE-betted amount is collected.

The SPLIT button 82 is a button to be operated in a case where the numbers displayed on two cards which are delivered in a game are identical to each other and the two cards are divided into two hands. When the SPLIT button 82 is operated, a player can compete with the dealer by means of hands of two or more groups of cards. The Double Down button 83 is a button to be operated in a case where a bet amount is doubled in a game.

In addition, a HELP button 84 is provided at a lower side of the STAND button 78. The HELP button 84 is a button to be operated when an operating method of the gaming machine 1 is displayed on the liquid crystal display 10. Further, a message area 85 for displaying a message to support the progress of a game is provided at the right side of the HELP button 84.

Furthermore, at a lower side of the bet screen 70, a bet amount display area 90 is provided for displaying a bet amount which is currently betted by a player; and an acquired amount display area 91 is provided for displaying the amount that is awarded to a player as a prize in a game. In addition, an owned credit display area 92 is provided for displaying the number of credits which are currently owned by a player; and a bet amount lower limit display area 93 is provided indicating a lower limit of the bet amount that can be betted by a player. Further, a bet amount upper limit display area 94 is provided indicating an upper limit of the bet amount that can be betted by a player.

In addition, a win or loss display region 95 indicating a win or loss between each of the players and the dealer in a current game is provided at the left side of the player card display region 71. The win or loss of blackjack used here is that a winner is the closest to 21 in a range in which a total of numbers of delivered cards does not exceed 21 or in a case where the total is identical, the result is draw. Further, in the case where the result is draw, the "DRAW" characters are displayed in the win or loss display region 95. In addition, in a case where a player has won, the "YOU WON" characters are displayed. Further, in a case where a player has lost, the "YOU LOST" characters are displayed.

Next, programs in which a blackjack game is executed by means of the gaming machine 1 will be described with reference to FIG. 8 to FIG. 15.

Figure 8:
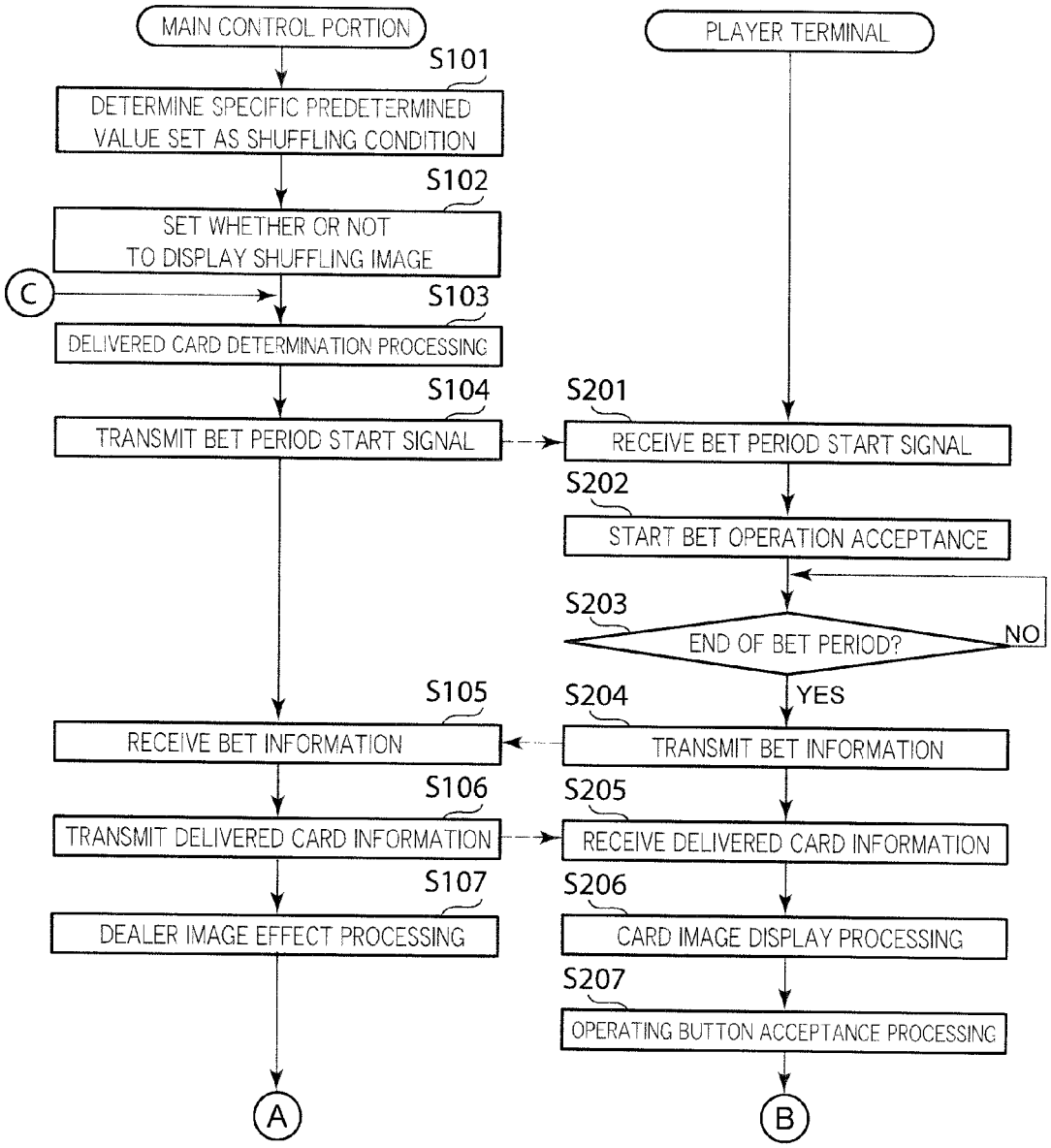
FIG. 8 It is a flowchart showing a subroutine of game processing.
Figure 9:
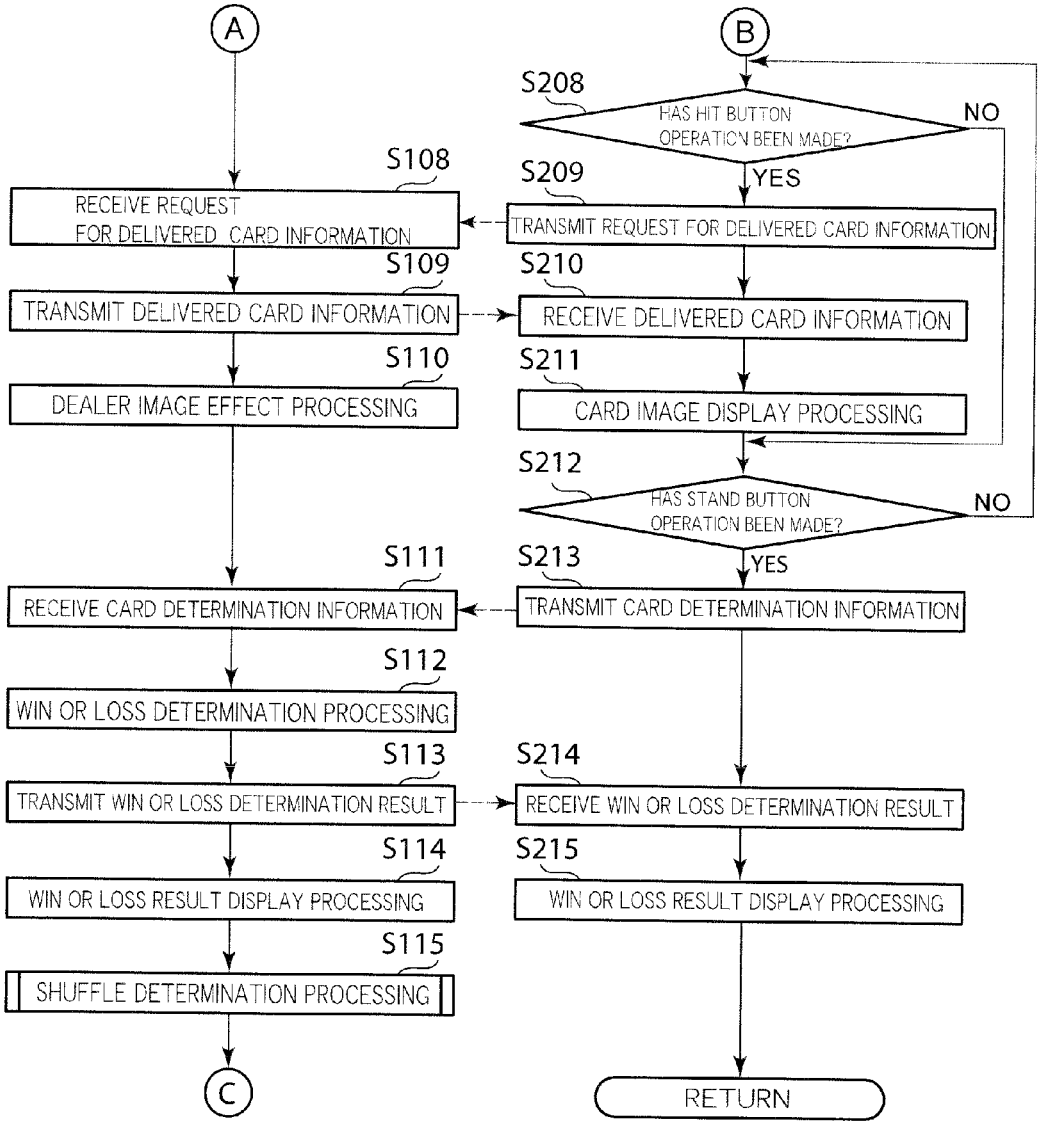
FIG. 9 It is a flowchart illustrating a subroutine of the game processing.

Now, game processing will be described with reference to FIG. 8 and FIG. 9. FIG. 8 and FIG. 9 are flowcharts illustrating a subroutine of game processing executed in corporation between a main control portion 31 and a player terminal 4.

First, processing of a CPU 41 of a main control portion 31 will be described. As shown in FIG. 8, in step S101, the CPU 41 of the main control portion 31 determines the number of cards to be set as a condition for shuffling a plurality of cards. Here, the CPU 41 determines a specific number of cards (for example, 80 cards), which is set as a condition for shuffling a plurality of cards, from among the number of cards (for example, 52, 80, 104 cards) that is stored in advance in a RAM 42 on the basis of an input signal from a shuffle setting switch 122 which is operable at the casino store side. Then, the CPU 41 stores the thus determined specific number of cards (for example, 80 cards) in a setting storage region of the RAM 42.

Next in step S102, the CPU 41 of the main control portion 31 sets whether or not to display an effect image of shuffling a plurality of cards on a common display 21. Here, the CPU 41 stores setting information in a display setting storage region of the RAM 42 on the basis of an input signal from a display switch 123 which is operable at the casino store side.

Next in step S103, the CPU 41 of the main control portion 31 determines cards to be delivered to players or a dealer. Here, if the number of cards that is used in a game is N (for example, N=208), the CPU 41 associates any number (arrangement sequential order) of 1 to N with a plurality of cards. Then, the CPU 41 determines cards to be delivered to the players or dealer on the basis of the card numbers associated by numbers. In other words, the CPU 41 delivers cards to the dealer and each of the players on a two-by-two cards basis in accordance with the sequential order of the determined card numbers.

Next in step S104, the CPU 41 of the main control portion 31 transmits to each player terminal 4 a command for starting a bet period to accept a bet operation made by the player. The bet period start command is a command for starting acceptance of a bet operation made by the player at each of the player terminals 4.

Next in step S105, the CPU 41 of the main control portion 31 receives bet information transmitted from each of the player terminals 4. The bet information used here includes information relating to a bet amount (the number of credits) which is betted by a player. Then, the CPU 41 temporarily stores the received bet information from each of the player terminals 4 in the RAM 42.

Next in step S106, the CPU 41 of the main control portion 31 transmits to each of the player terminals 4 the information relating to the cards that are delivered to each of the player terminals 4 (such as heart 7 or spade A, for example) on the basis of the delivered cards that are determined in step S103 described previously.

Next in step S107, the CPU 41 of the main control portion 31 displays an image of a dealer delivering cards to each of the players and the dealer on a two-by-two cards basis, on a common display 21 as a main screen 101. With respect to the second card delivered to the dealer, a kind of mark is not displayed at a time point when the card is delivered.

Next as shown in FIG. 9, in step S108, the CPU 41 of the main control portion 31 receives a request for information on a new delivery card which is transmitted from each of the player terminals 4. Then in step S109, the CPU 41 transmits information relating to third and subsequent cards upon a request to a player terminal 4 having transmitted such a request. Then, in step S110, the CPU 41 displays an image of the dealer delivering cards to the player having requested such a new card on the common display 21 as the main screen 101.

Next in step S111, the CPU 41 of the main control portion 31 receives card determination information which is transmitted from each of the player terminals 4. The card determination information used here denotes information to be transmitted from a player terminal 4 in a case where a player has selected competing with the dealer by using currently delivered cards. Then, the CPU 41 receives the card determination information from each player terminal 4 when the STAND button 78 has been selected from the player terminal 4.

Next in step S112, the CPU 41 of the main control portion 31 performs win or loss determination processing of comparing the cards that are delivered to the dealer and the cards that are delivered to the players with each other. Specifically, the CPU 41 determines that a winner is the closest to 21 in a range in which a total of numbers that is displayed on the delivered cards does not exceed 21 and determines a draw in a case where the total of numbers that is displayed on the delivered cards is identical.

Next in step S113, the CPU 41 of the main control portion 31 transmits the win or loss determination result obtained in the step S111 described previously to each of the player terminals 4. Then, in step S114, the CPU 41 displays win or loss result images 110 to 114 indicating a win or loss determination result of each of the player terminals 4, on the main screen 101 of the common display 21.

Next in step S115, the CPU 41 of the main control portion 31 performs shuffle determination processing. Specifically, in a case where the number of cards that is used in a plurality of times of blackjack games which are played has reached the specific number of cards (for example, 80 cards) that is determined in step S101 described previously, the CPU 41 shuffles a plurality of cards at the time of starting a next game. Processing of shuffling these cards will be described later. Then, the CPU 41 performs the processing in step S115 and then causes the routine to return to step S103 again in order to perform a next game.

Next, processing of a CPU 51 of a player terminal 4 will be described. First in step S201, the CPU 51 of the player terminal 4 receives a command for starting a bet period, the command having been transmitted from the main control portion 31 in step S104.

Next in step S202, the CPU 51 of the player terminal 4 starts acceptance of a bet operation. Here, the CPU 51 displays a bet screen 70 on a liquid crystal display 10 and then specifies a bet amount (the number of credits) that is betted on the basis of operation information from a touch panel 11 to thereby accept the bet operation.

Next in step S203, the CPU 51 of the player terminal 4 determines whether or not a bet period has completed. Specifically, the CPU 51 determines whether or not a predetermined time (for example, 20 seconds) has elapsed after acceptance of the bet operation has been started in step S202 to thereby determine whether the bet period has completed.

Then in step S203, in a case where the CPU 51 of the player terminal 4 determines that the bet period has not completed (S203: NO), the CPU 51 continuously performs acceptance of the bet operation. Alternatively, in a case where the CPU 51 determines that the bet period has completed (S203: YES), the CPU 51 causes the routine to proceed to step S204 in which bet information is transmitted to the main control portion 31. The bet information used here includes information relating to a bet amount (the number of credits) that is betted by a player.

Next in step S205, the CPU 51 of the player terminal 4 receives information (kinds of marks) on the first and second delivery cards that are delivered to the players playing a game at the player terminals 4, the cards having transmitted from the main control portion 31 in step S106 described previously. Then in step S206, the CPU 51 displays the cards that are delivered onto the bet screen 70 on the basis of the information on the cards that is received from the main control portion 31 in step S205.

Next in step S207, the CPU 51 of the player terminal 4 performs operating button acceptance processing of starting acceptance of operation of a variety of operating buttons 78 to 81 which are displayed on the bet screen 70. Then in step S208, the CPU 51 determines whether or not a HIT button 79 has been operated. In a case where the CPU 51 determines that the HIT button 79 has been operated (S208: YES), the CPU 51 transmits a delivery card information request adapted to request delivery of a new card to the main control portion 31.

Next in step S210, the CPU 51 of the player terminal 4 receives information on the card that is newly transmitted from the main control portion 31 in step S109. Then, in step S211, the CPU 51 displays a card which is newly associated with the bet screen 70 on the basis of the information on the card that is received from the control portion 31. Alternatively, in a case where the CPU 51 determines that the HIT button 79 has not been operated (S208: NO), the CPU 51 causes the routine to migrate to step S212.

Next in step S212, the CPU 51 of the player terminal 4 determines whether or not a STAND button 78 has been operated. Then in step S213, in a case where the CPU 51 determines that the STAND button 78 has been operated (S212: YES), the CPU 51 transmits to the main control portion 31 card determination information indicating that the player competes with the dealer by using currently displayed cards. In addition, in a case where the CPU 51 determines that the STAND button 78 has not been operated (S212: NO), the CPU 51 causes the routine to return to step S208. In a case where any one of other operating buttons 80 to 84 has been operated, the CPU 51 performs processing according to the operated button.

Next in step S214, the CPU 51 of the player terminal 4 receives the win or loss determination result that is transmitted from the main control portion 31 in step S113.

Next in step S215, the CPU 51 of the player terminal 4 displays a win or loss determination result of a player who plays a game at a player terminal on the liquid crystal display 10 on the basis of the win or loss determination result that is received in step S214. Specifically, in a case where the result is draw, the CPU 51 displays the "DRAW" characters in a win or loss display region 95 on a bet screen 70. In addition, in a case where a player has won, the CPU 51 displays the "YOU WON" characters. Further, in a case where the player has lost, the CPU 51 displays the "YOU LOST" characters. After the CPU 51 has performed the processing in step S215, the CPU 51 causes the routine to return to step S201 in order to perform a next game again.

Figure 10:
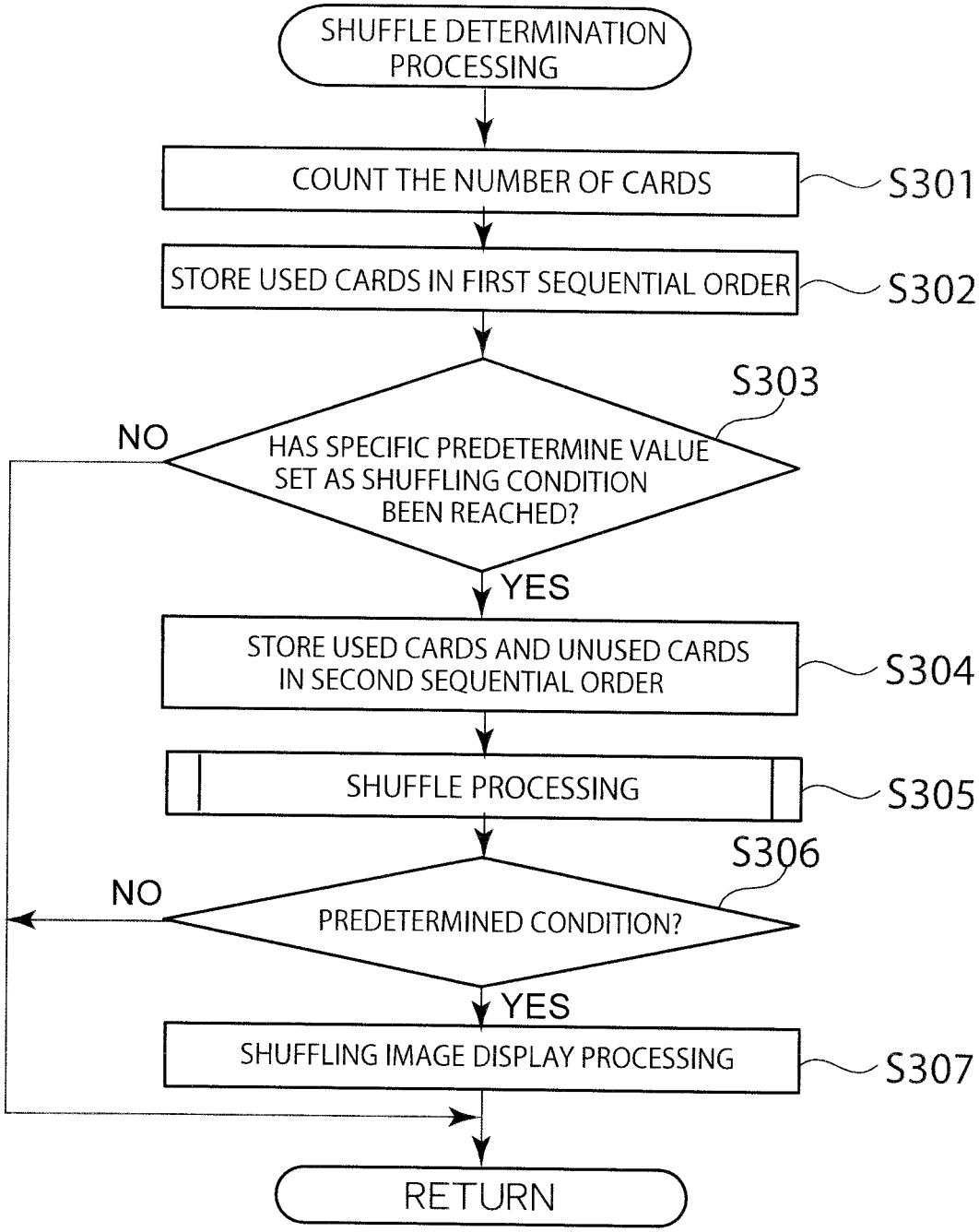
FIG. 10 It is a flowchart illustrating a subroutine of shuffle determination processing.
Figure 11:
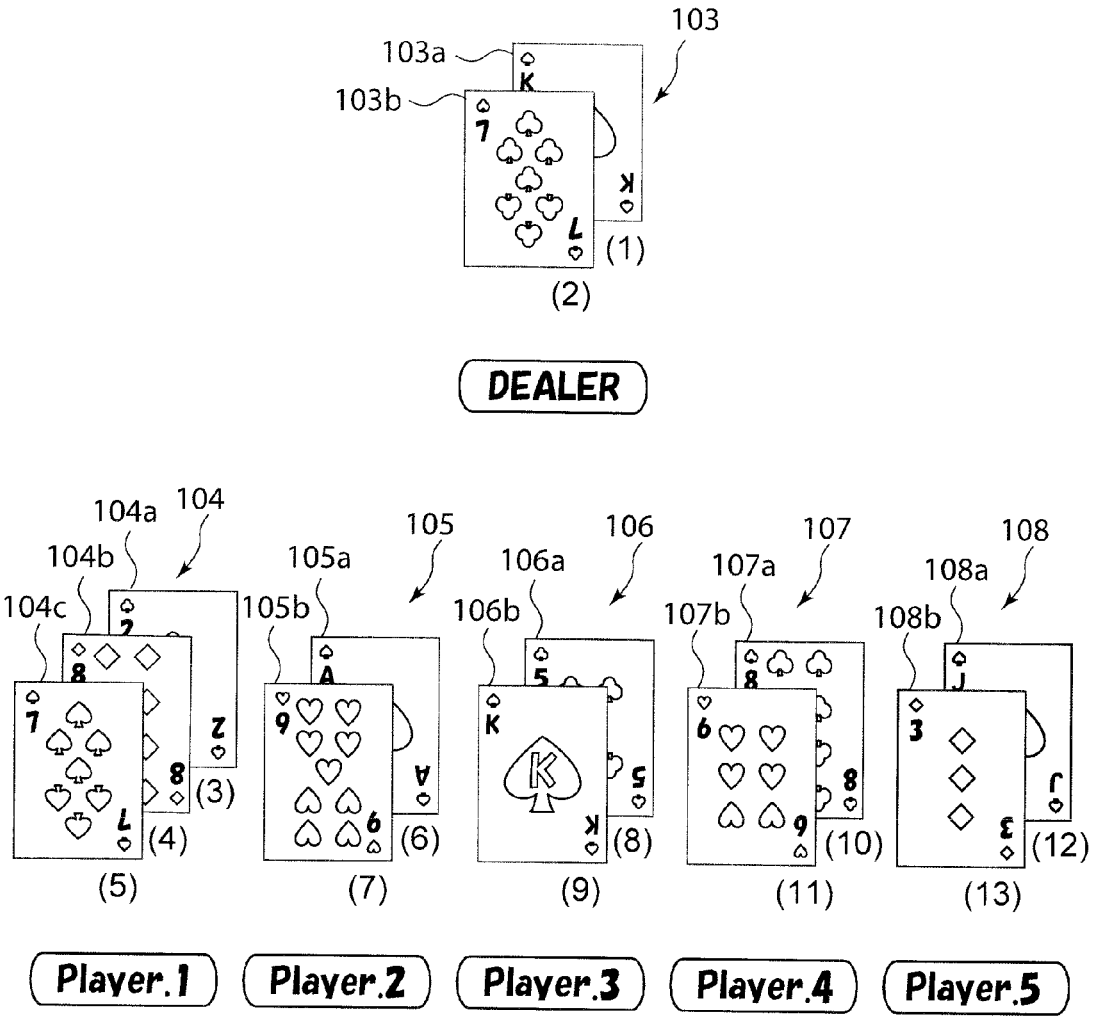
FIG. 11 It is an explanatory view of a method of storing cards in memory in a first sequential order.
Figure 12:
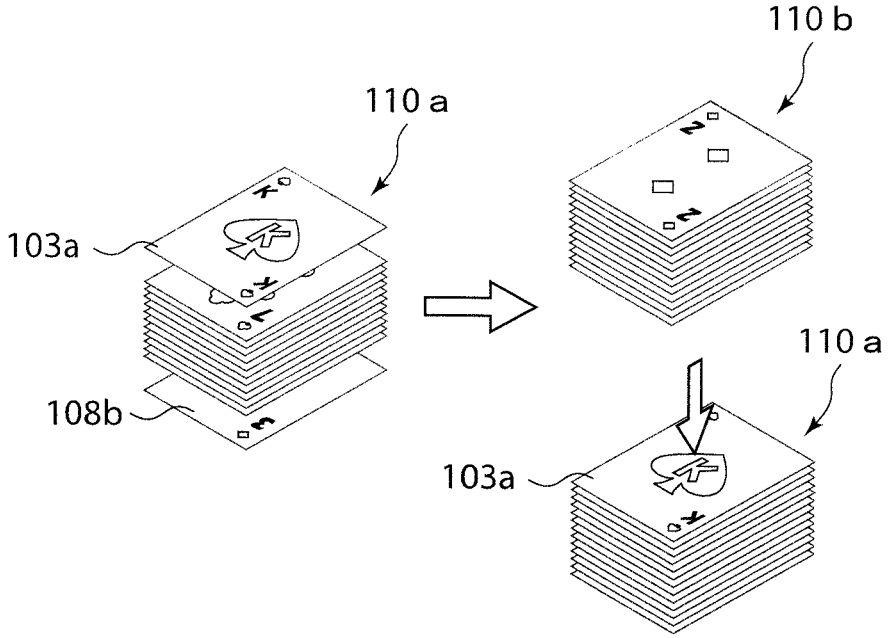
FIG. 12 It is an explanatory view of the method of storing cards in memory in the first sequence.
Figure 13:
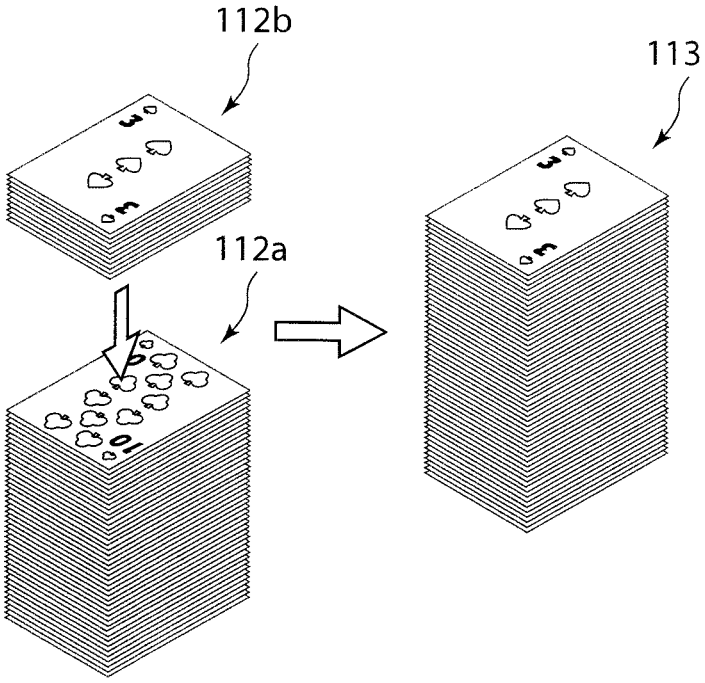
FIG. 13 It is an explanatory view of a method of storing cards in memory in a second sequential order.

Next, shuffle processing will be described with reference to FIG. 10 to FIG. 13. With respect to the shuffle processing described here, step S115 in FIG. 9 described previously, which is executed by a CPU 41 of a main control portion 31, will be described in more detail. FIG. 10 is a flowchart illustrating a subroutine of shuffle determination processing; FIG. 11 and FIG. 12 are explanatory views of a method of storing cards in a first sequential order; and FIG. 13 is an explanatory view of a method of storing cards in memory in a second sequential order.

As shown in FIG. 10, first in step S301, the CPU 41 of the main control portion 31 counts the number of cards. Specifically, the CPU 41 cumulatively counts the number of dealer cards and the number of player cards (used cards) which have been used in a game, in the game processing operations shown in FIG. 8 and FIG. 9.

Next in step S302, the CPU 41 of the main control portion 31 cumulatively stores the used cards that are counted in step S301 in the first sequential order in a region for storing the used cards in the RAM 42 (see FIG. 11 and FIG. 12). Hereinafter, a description will be given by way of example of a case in which dealer cards 103 which are delivered to a dealer and player cards 104 to 108 which are delivered to each of player 1 to player 5 (a maximum of five players in the embodiment) who play a game at each of the player terminals 4, are stored in the RAM 42 in the first sequential order.

As shown in FIG. 11, the CPU 41 of the main control portion 31 associates numbers (sequential order of re-collecting cards) in a sequential order which is determined for the dealer cards 103 and the player cards 104 to 108. In this example, the CPU 41 associates a number 1 with a first card 103*a* and a number 2 with a second card 103*b* from among the dealer cards 103. In addition, the CPU 41 associates a number 3 to a first card 104*a*, a number 4 with a second card 104*b*, and a number 5 with a third card 104*c* from among the player cards 104 that are delivered to a player 1.

Then, the CPU 41 of the main control portion 31 associates numbers 6 and 7 with player cards 105*a* and 105*b* which are delivered to a player 2; numbers 8 and 9 with player cards 106*a* and 106*b* which are delivered to a player 3; numbers 10 and 11 with player cards 107*a* and 107*b* which are delivered to a player 4; and numbers 12 and 13 with players cards 108*a* and 108*b* which are delivered to a player 5.

Next as shown in FIG. 12, the CPU 41 of the main control portion 31 stores cards 103 to 108 in a region for storing the used cards in the RAM 42, so that: cards whose numbers are smaller are arranged on the upper side; and cards whose numbers are greater are arranged on the lower side. Here, the CPU 41 stores cards 103*a* to 108*b* in the RAM 42 so that: the first card 103*a* is arranged on the top; and the 13th card 108*b* is arranged on the bottom.

Next as shown in FIG. 12, the CPU 41 of the main control portion 31 associates the numbers with the dealer cards and player cards that are delivered in a next game in a manner which is similar to that described previously. Then, the CPU 41 cumulatively stores in the RAM 42 the cards that are used in each game so that a card 110*b* which is to be delivered in a next game and with which the number has been associated is arranged on the upper side and a card 110*a* which is used in the previous game is arranged on the lower side.

Namely, the first sequential order denotes a state in which the cards that are delivered to the dealer and each player are re-collected in sequential order of numbered cards and then the used cards that are re-collected in a next game are arranged on the used cards that are re-collected in the previous game on a game-by-game basis.

Next as shown in FIG. 10, in step S303, the CPU 41 of the main control portion 31 determines whether or not a specific number of cards (for example, 80 cards) which is set as a condition for shuffling cards has been reached. Specifically, a CPU 51 determines whether or not the number of cards that is counted in step S301 (used in a game) has reached the specific number of cards (for example, 80 cards) that is set as a shuffling condition on the basis of an input signal of a shuffle setting switch 122 from the casino store side in step S101 shown in FIG. 8.

Then, when the CPU 41 of the main control portion 31 determines that the number of cards that is used in a game has not reached the number of cards (for example, 80 cards) that is set as a shuffling condition (S303: NO), the CPU 41 completes shuffle determination processing. In addition, when the CPU 41 determines that the number of cards that is used in a game has reached the specific number of cards (for example, 80 cards) that is set as a shuffling condition (S303: YES), the CPU 41 causes the routine to migrate to step S304.

Next in step S304, the CPU 41 of the main control portion 31 stores the used cards and the unused cards that have not been used in the game, in the RAM 42 in a second sequential order. The second sequential order used here denotes that: a group of used cards is arranged under a group of unused cards; and that as shown in FIG. 13, a used card group 112*a* in which cards are associated with numbers in the first sequential order and the cards associated with the numbers are stored in the RAM 42 is arranged under an unused card group 112*b*. Then, the used card group 112*a* and the unused card group 112*b* are combined with each other, whereby a card group 113 targeted for shuffling is formed (see FIG. 13).

Next in step S305, the CPU 41 of the main control portion 31 performs is shuffle processing. The shuffle processing will be described later in detail.

Next in step S306, the CPU 41 of the main control portion 31 determines whether a condition for displaying an effect image of shuffling cards is set. Specifically, in a case where the CPU 41 determines that the condition has been set (S306: YES), the CPU 41 causes the routine to proceed to step S307 in which an effect image is displayed on the basis of the shuffle processing that is performed in step S305, or alternatively, in a case where the CPU 41 determines that the condition has not been set (S306: NO), the CPU 41 completes shuffle processing without displaying an effect image.

Next in step S307, in a case where the CPU 41 of the main control portion 31 determines that a condition for displaying an effect image of shuffling cards has been set (S306: YES), the CPU 41 reads out the effect image of shuffling the cards that are stored in the RAM 42 on the basis of an input signal from a display switch 123 which is operable on the casino store side in step S102 shown in FIG. 8 and then displays the effect image of shuffling the cards on the basis of the read out image, on a common display 21, in such a manner that the image becomes visible for the players.

Figure 14:
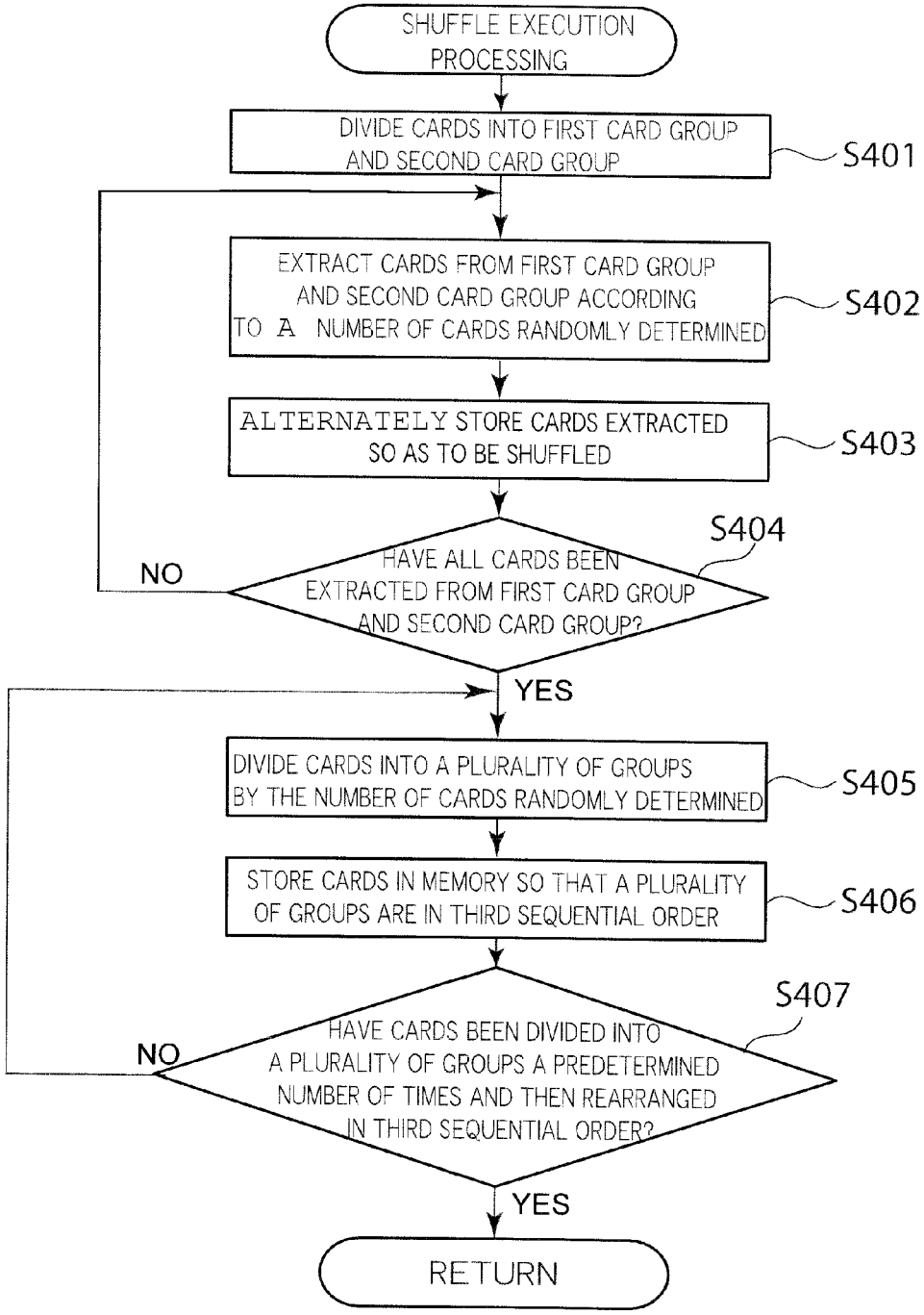
FIG. 14 It is a flowchart illustrating a subroutine of shuffle processing.
Figure 15:
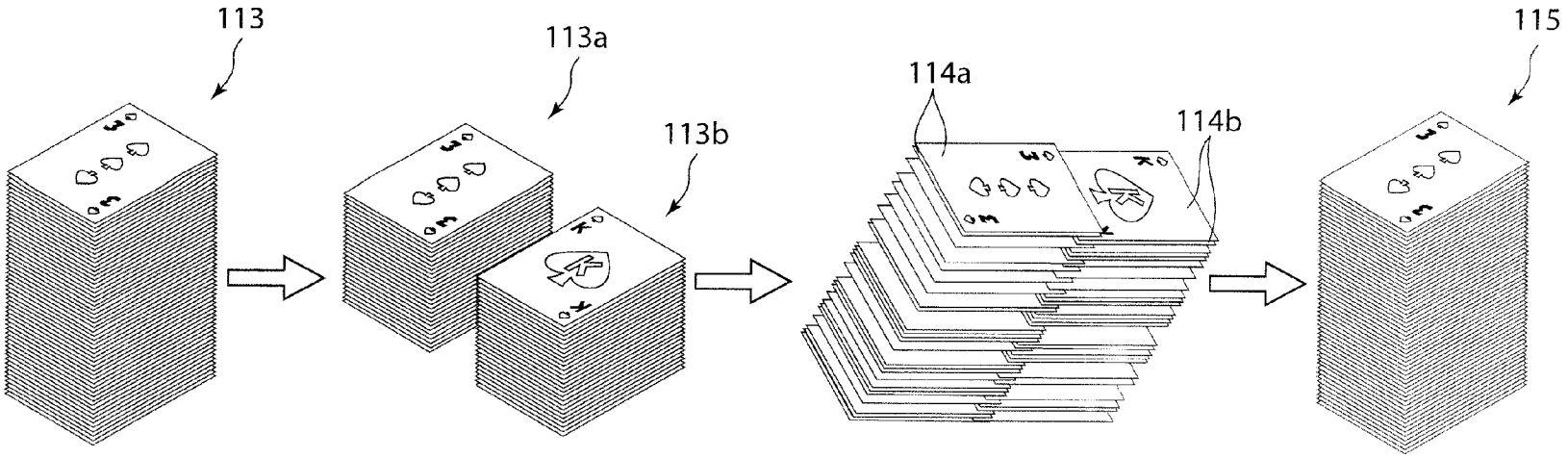
FIG. 15 It is an explanatory view of a method of shuffling cards.
Figure 16:
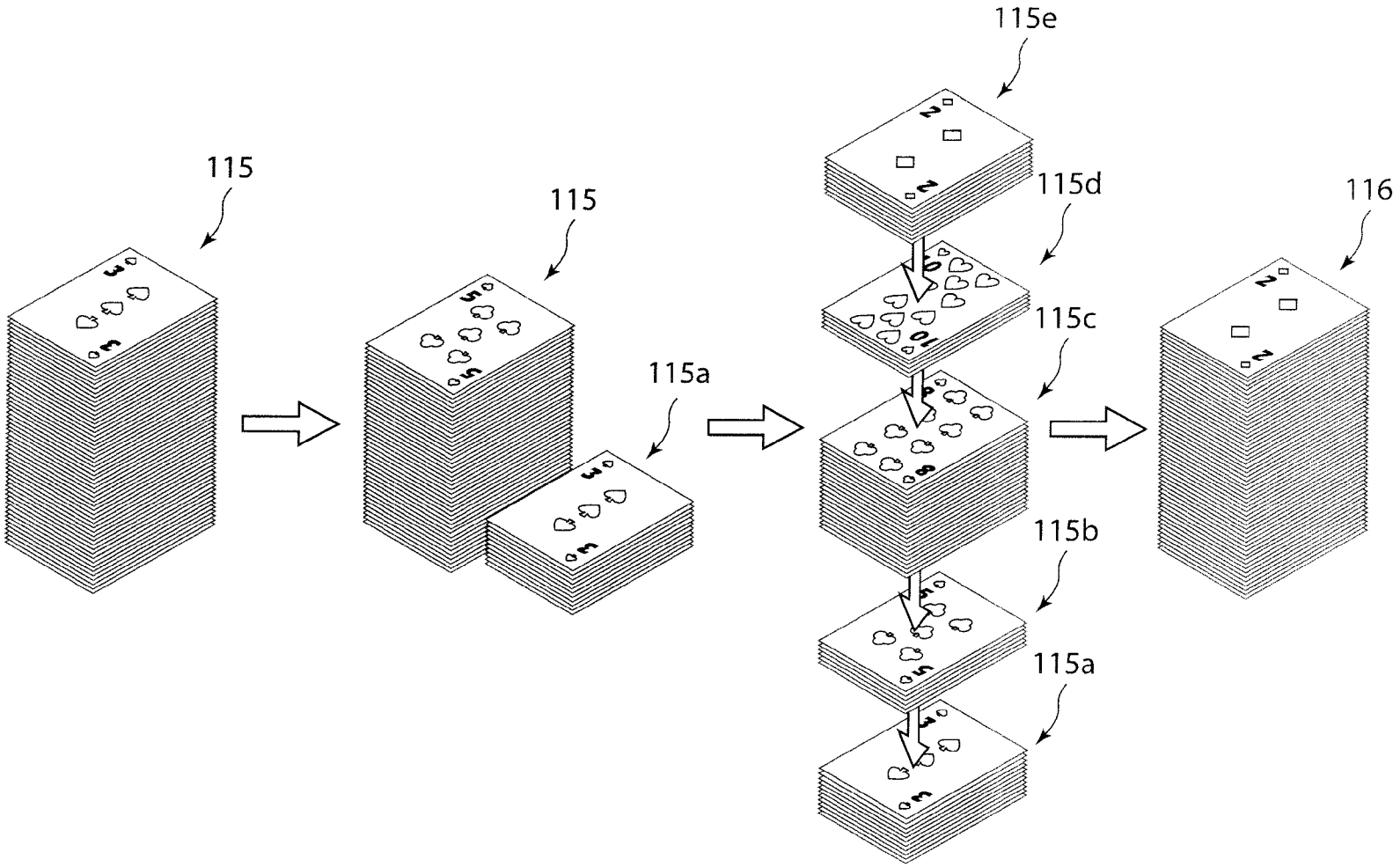
FIG. 16 It is an explanatory view of a method of storing a plurality of card groups in memory in a third sequential order.

Next, shuffle processing will be described with reference to FIG. 14 to FIG. 16. The shuffle processing refers to the processing in step S305 shown in FIG. 10. FIG. 14 is a flowchart illustrating a subroutine of the shuffle processing; FIG. 15 is an explanatory view of a method of shuffling cards; and FIG. 16 is an explanatory view of a method of storing a plurality of card groups in memory in a third sequential order.

First as shown in FIG. 14, in step S401, a CPU 41 of a main control portion 31 divides a plurality of cards made of used cards and unused cards, which are stored in a second sequential order, into a first card group and a second card group. As shown in FIG. 15, the CPU 41 divides shuffling cards 113 (for example, 208 cards) into a first card group 113*a* and a second card group 113*b*.

Next in step S402, the CPU 41 of the main control portion 31 extracts cards from the first card group 113*a* and the second card group 113*b* according to a number of cards that is randomly determined. As shown in FIG. 15, the CPU 41 randomly determines a predetermined number of cards (for example, one to five cards) to be extracted from each card group 113*a* and 113*b*. Afterwards, according to the randomly determined number of cards to be extracted from each card group 113*a* and 113*b*, the CPU 41 extracts a first extraction card set 114*a* from the first card group 113*a* and then extracts a second extraction card set 114*b* from the second card group 113*b*.

Next in step S403, the CPU 41 of the main control portion 31 alternately stores the extracted cards in the RAM 42 so as to shuffle the first card group 113*a* and the second card group 113*b*. Subsequently as shown in FIG. 15, the CPU 41 stores in the RAM 42 a card group 115 which is obtained by alternately arranging the first extraction card sets 114*a* that have been extracted from the first card group 113*a* and the second extraction card sets 114*b* that have been extracted from the second card group 113*b*. The randomly determined number of cards to be extracted from each card group 113*a* and 113*b* can be different as between the two card groups 113*a* and 113*b* and for successive extractions of card sets 114*a* and 114*b* from the card groups 113*a* and 113*b*, respectively. For example, as shown in FIG. 15, the randomly determined number of cards in each successive card set 114*a*, 114*b* is, alternating between card sets 114*a* and 114*b* and from top to bottom, 2, 2, 1, 3, 1, 1, 1, 1, 1, 1, 1, 3, 2, 4, 4, 2, 1, 3, 3, 1, 1, 1, 3, 1, 1, 2, 2, 1, 1.

Next in step S404, the CPU 41 of the main control portion 31 determines whether or not all of the cards have been extracted from the first card group 113*a* and the second card group 113*b*. Then, in a case where the CPU 41 determines that all of the cards have not been extracted from the first card group 113*a* and the second card group 113*b* (S404: NO), the CPU 41 causes the routine to return to step S402. Alternatively, in a case where the CPU 41 determines that all of the cards have been extracted from the first card group 113*a* and the second card group 113*b* (S404: YES), the CPU 41 causes the routine to proceed to step S405.

Next in step S405, the CPU 41 of the main control portion 31 divides the card group 115 into a plurality of groups by a number of cards that is randomly determined (for example, one card to 26 cards). As shown in FIG. 16, the CPU 41 randomly determines the number of cards (for example, one card to 26 cards). Afterwards, according to the determined number of cards, the CPU 41 divides the card group 115 into a first group 115*a*, a second group 115*b*, a third group 115*c*, a fourth group 115*d*, and a fifth group 115*e*.

Next in step S406, the CPU 41 of the main control portion 31 stores in memory a card group which is formed by arranging a plurality of groups in the third sequential order. As shown in FIG. 16, the CPU 41 rearranges the first group 115*a* to the fifth group 115*e* so that the first group is arranged on the bottom and the fifth group 115*e* is arranged on the top. Then, the CPU 41 stores a rearranged card group 116 in the RAM 42.

Next in step S407, the CPU 41 of the main control portion 31 divides the card group into a plurality of groups a predetermined number of times and then determines whether or not the plurality of groups have been rearranged in the third sequential order. Specifically, the CPU 41 determines whether or not the processing operations in step S405 and step S406 have been repeated a predetermined number of times (five times in the embodiment). The CPU 41 then divides the card group into a plurality of groups a predetermined number of times. In a case where the CPU 41 determines that the plurality of groups have not been rearranged in the third sequential order (S407: NO), the CPU 41 causes the routine to return to step S405. In addition, the CPU 41 divides the card group into a plurality of groups a predetermined number of times. In a case where the CPU 41 determines that the plurality of group have been rearranged in the third sequential order (S407: YES), the CPU 41 completes shuffle processing. Then, the routine proceeds to the processing in step S306 shown in FIG. 10 and then an effect image of shuffling cards is displayed on a common display 21.

While the foregoing embodiment described a case of shuffling a plurality of cards in a case where the number of cards that is used in a game has reached the number of cards that is determined on the store side, the present invention is not limitative thereto, and in a case where the number of cards that is used in a game has reached the number of cards that is determined on the store side, it may be determined as to whether or not to shuffle cards.

In addition, the foregoing embodiment described: a first shuffle of shuffling cards which are extracted from unused cards and used cards according to the number of cards that is randomly determined after the used cards used in a game and unused cards which have not been used in the game have been divided into two card groups; and a second shuffle of shuffling cards again after the shuffled card groups have been divided into a plurality of groups. However, the present invention is not limitative thereto, and in a game, only the first shuffle may be performed without performing the second shuffle.

Further, while the foregoing embodiment described determining whether to display an image of shuffling cards on a common display in response to an input signal of a display setting switch 123 from the store side, the present invention is not limitative thereto, an image of shuffling cards may be always displayed on a common display and whether or not to display the effect image of shuffling cards described previously may be determined by referring to a win or loss result in game history.

Furthermore, while the foregoing embodiment described determining a timing of shuffling cards in response to an input signal of a shuffle setting switch 122 from the store side, the present invention is not limitative thereto, and a timing of shuffling cards may be determined in response to an input signal from a central computer included in the store side.

Still furthermore, while the foregoing embodiment described determining a timing of cards on the basis of an input signal from the store side, the present invention is not limitative thereto, and for example, a timing of shuffling cards may be determined on the basis of an input signal from the store side according to a game win or loss history. In other words, different timings of shuffling cards may be set variably in place of fixedly setting the timing of shuffling cards at a gaming machine 1.

While the embodiment of the present invention has been described hereinbefore, it should be noted that: the foregoing embodiment is merely provided as a specific example and does not limit the present invention in particular; and further, a design change can be appropriately made for specific features such as means. In addition, the advantageous effects described in the embodiment of the present invention are merely enumerated as the most preferred advantageous effects derived from the present invention, and are not limited to the descriptive matters appearing in the embodiment of the present invention.

The invention claimed is:

1. A gaming machine, comprising:

(i) a memory for storing a plurality of cards and a plurality of predetermined values which serve as a condition for shuffling the plurality of cards after a predetermined number of cards have been selected from among the plurality of cards and used in a game; and (ii) a processor, the processor being configured to execute processing operations including:

(a) determining a specific predetermined value from among the plurality of predetermined values, which specific predetermined value is set as a condition for shuffling the plurality of cards, and is based on an input signal which is inputted from a store side;

(b) after execution of said processing (a), determining dealer cards and player cards which are used in the game from among the plurality of cards and then executing the game, in which game the determined dealer and player cards are compared with each other;

(c) cumulatively counting the number of cards that are used in the processing (b);

(d) cumulatively storing in the memory, as used cards, the cards that are used in the processing (b);

(e) determining whether or not the number of cards that have been used and counted in the processing (c) has reached the specific predetermined value as a result of repeating the processing operations (b) to (d); and (f) shuffling the plurality of cards, at a time of starting a next game, in a case where it is determined in the processing (e) that the cumulatively counted number of used cards has reached the specific predetermined value that has been determined in the processing (a) before execution of said processing (b);

wherein in the processing (d), the used dealer cards and player cards are cumulatively stored in a first sequential order in a region of the memory for storing the used cards; and in the processing (f), (f1) in a case where it is determined in the processing (e) that the cumulatively counted number of used cards has reached the specific predetermined value that has been determined in the processing (a), forming a combined group of used and unused cards from (i) the cumulatively used cards and (ii) unused cards that have not been used in a game and storing the combined group of cards in the memory in a second sequential order of cards;

(f2) dividing the combined group of used and unused cards into a first card group and a second card group;

(f3) extracting cards from the first card group and from the second card group according to a randomly determined number and combining the extracted cards in a manner that causes the first card group and the second card group to be shuffled together to form a shuffled group of cards and storing the shuffled group of cards in the memory.

2. The gaming machine according to claim 1, wherein the processor is configured to execute further processing operations including:

(f4) dividing the shuffled group of cards into a plurality of cut groups of cards according to a randomly determined number of cards; and (f5) combining the plurality of cut groups of cards into a re-stacked group of cards and storing the re-stacked group of cards in the memory in a third sequential order of cards.

3. The gaming machine according to claim 1, wherein the random number according to which cards are extracted from the first card group and from the second card group is independently determined for each of the first and second card groups.

4. The gaming machine according to claim 3, wherein the random number according to which cards are extracted from the first card group and from the second card group differs as between the first card group and the second card group.

5. The gaming machine according to claim 1, wherein the manner that causes the first card group and the second card group to be shuffled together is an alternating arrangement of card sets extracted from the first card group and from the second card group.

6. The gaming machine according to claim 1, wherein the cards are extracted from the first card group and from the second card group in card sets having one or more cards therein.

7. A gaming machine, comprising:

(i) a memory for storing a plurality of cards and a plurality of predetermined values which serve as a condition for shuffling the plurality of cards after a predetermined number of cards have been selected from among the plurality of cards and used in a game; and (ii) a processor, the processor being configured to execute processing operations including:

(a) determining a specific predetermined value from among the plurality of predetermined values, which specific predetermined value is set as a condition for shuffling the plurality of cards, and is based on an input signal which is inputted from a store side;

(b) after execution of said processing (a), determining dealer cards and player cards which are used in the game from among the plurality of cards and then executing the game, in which game the determined dealer and player cards are compared with each other;

(c) cumulatively counting the number of cards that are used in the processing (b);

(d) cumulatively storing in the memory, as used cards, the dealer cards and the player cards that have been used in the processing (b), the used cards being stored in a first sequential order in a region of the memory for storing the used cards;

(e) determining whether or not the number of cards that have been used and counted in the processing (c) has reached the specific predetermined value as a result of repeating the processing operations (b) to (d);

(f) in a case where it is determined in the processing (e) that the cumulatively counted number of used cards has reached the specific predetermined value that has been determined in the processing (a), forming a combined group of used and unused cards from (i) the cumulatively used cards and (ii) unused cards that have not been used in a game and storing the combined group of cards in the memory in a second sequential order of cards;

(g) dividing the combined group of used and unused cards into a first card group and a second card group;

(h) extracting cards from the first card group and the second card group according to the number of cards that is randomly determined; and (i) alternately combining the extracted cards so as to shuffle together the cards in the first card group and the second card group, thereby forming a shuffled group of cards, and storing the shuffled group of cards in the memory.

8. The gaming machine according to claim 7, further comprising:

a player terminal for a player to play a game;

a card shuffling switch that is used to set the condition for shuffling the plurality of cards and a shuffle display switch; and a common display to which the player terminal is connected, wherein, in the processing operations (f) to (h), the processor executes processing of displaying an image of shuffling the plurality of cards on the common display according to a predetermined condition that has been set using the shuffle display switch; and wherein the condition for shuffling the plurality of cards and the predetermined condition according to which shuffling of the cards is displayed are independent of each other.

9. The gaming machine according to claim 7, wherein the processor is configured to execute further processing operations including:

(j) dividing the shuffled group of cards, into a plurality of cut groups of cards according to a randomly determined number of cards; and (k) combining the plurality of cut groups of cards into a re-stacked group of cards and storing the re-stacked group of cards in the memory in a third sequential order.

10. A gaming machine control method, comprising the steps of:

(a) based on an input signal which is inputted from a store side, determining a specific predetermined value from among a plurality of predetermined values that have been stored in a memory, which specific predetermined value is set as the condition for shuffling a plurality of cards that are stored in the memory;

(b) after execution of the step (a), determining dealer cards and player cards which are used in a game from among the plurality of cards and then executing the game, in which game the determined dealer and player cards are compared with each other;

(c) cumulatively counting the number of cards that are used in the step (b);

(d) cumulatively storing in the memory, as used cards, the cards that are used in the step (b);

(e) determining whether or not the number of cards that have been used and counted in the step (c) has reached the specific predetermined value as a result of repeating the processing operations (b) to (d); and (f) in a case where it is determined in the step (e) that the cumulatively counted number of cards has reached the specific predetermined value determined in the step (a) before execution of said step (b), shuffling the plurality of cards at a time of starting a next game;

wherein:

in the step (d), the dealer cards and the player cards that are used in the step (b) are cumulatively stored in a first sequential order in a region of the memory for storing the used cards; and the step (f) of shuffling cards includes the steps of:

(f1) in a case where it is determined in the step (e) that the cumulatively counted number of used cards has reached the specific predetermined value that has been determined in the step (a), forming a combined group of used and unused cards from (i) the cumulatively used cards and (ii) unused cards that have not been used in a game and storing the combined group of cards in the memory in a second sequential order of cards;

(f2) dividing the combined group of used and unused cards into a first card group and a second card group; and (f3) extracting card sets from the first card group and from the second card group according to a randomly determined number and then alternately storing the extracted card sets in the memory so as to shuffle together the first card group and the second card group and form a shuffled group of cards.

11. The gaming machine control method according to claim 10, wherein the step (f) of shuffling the cards further includes the steps of:

(f4) dividing the shuffled group of cards into a plurality of cut groups of cards according to a randomly determined number; and (f5) combining the plurality of cut groups of cards into a re-stacked group of cards and storing the re-stacked group of cards in the memory in a third sequential order of cards.

12. The gaming machine according to claim 10, wherein the random number according to which the card sets are extracted from the first card group and from the second card group is independently determined for each of the first and second card groups.

13. The gaming machine according to claim 12, wherein the random number according to which the card sets are extracted from the first card group and from the second card group differs as between the first card group and the second card group.

14. The gaming machine according to claim 10, wherein the card sets have one or more cards therein.

* * * * *